US006471317B2

(12) United States Patent
Chang

(10) Patent No.: US 6,471,317 B2
(45) Date of Patent: Oct. 29, 2002

(54) LIQUID JETTING APPARATUS

(75) Inventor: Junhua Chang, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/832,347

(22) Filed: Apr. 11, 2001

(65) Prior Publication Data

US 2002/0076246 A1 Jun. 20, 2002

(30) Foreign Application Priority Data

Apr. 11, 2000 (JP) ..... 2000-109120

(51) Int. Cl.[7] ..... B41J 29/38; B41J 2/15
(52) U.S. Cl. ..... 347/9; 347/40
(58) Field of Search ..... 347/15, 9, 43, 347/40, 41

(56) References Cited

U.S. PATENT DOCUMENTS

| | | | | |
|---|---|---|---|---|
| 4,552,179 A | | 11/1985 | Tarusawa | 137/625.65 |
| 5,600,351 A | * | 2/1997 | Holstun et al. | 347/40 |
| 5,880,756 A | * | 3/1999 | Ishii et al. | 347/40 |
| 6,244,688 B1 | * | 6/2001 | Hickman | 347/43 |

FOREIGN PATENT DOCUMENTS

| | | | |
|---|---|---|---|
| EP | 0 925 920 | 6/1999 | B41J/2/01 |
| JP | 02(1990)-286250 | 11/1990 | B41J/3/04 |
| JP | 02(1990)-286251 | 11/1990 | B41J/3/04 |
| JP | 02(1990)-301446 | 12/1990 | B41J/3/04 |
| JP | 10(1998)-337864 | 12/1998 | B41J/2/01 |

OTHER PUBLICATIONS

JPO Abstract 02(1990)–286250, Nov. 26, 1990.
JPO Abstract 02(1990)–286251, Nov. 26, 1990.
JPO Abstract 02(1990)–301446, Dec. 13, 1990.

* cited by examiner

*Primary Examiner*—John Barlow
*Assistant Examiner*—Alfred E. Dudding
(74) *Attorney, Agent, or Firm*—Sughrue Mion, PLLC

(57) ABSTRACT

A head member includes a plurality of first nozzles forming a first nozzle row, a plurality of second nozzles forming a second nozzle row that is paired with the first nozzle row, and an ink supplying unit that supplies a same kind of liquid to each of the nozzles. There is a slight gap between a moving track of a first nozzle by a main scanning unit and a moving track of a second nozzle paired with the first nozzle by the main scanning unit. A controlling unit is adapted to control an ink jetting unit and the main scanning unit in such a manner that an ink jetting from the first nozzle and an ink jetting from the second nozzle paired with the first nozzle are carried out in a same main scan, based on jetting data for a same jetting unit area. According to the invention, even if main scans are not repeated, liquid jetting for the same jetting unit area can be carried out from the two nozzles.

25 Claims, 22 Drawing Sheets

| GRAY-TONE VALUE | T1 | T2 | T3 | T4 | T5 | T6 | DECODE VALUE |
|---|---|---|---|---|---|---|---|
| (0000) | ○ | × | × | ○ | × | × | (100100) |
| (0001) | × | × | ○ | ○ | × | × | (001100) |
| (0010) | ○ | ○ | × | × | × | × | (110000) |
| (0011) | ○ | ○ | ○ | ○ | × | × | (111100) |
| (0100) | × | × | × | × | ○ | ○ | (000011) |
| (0101) | × | × | ○ | ○ | ○ | ○ | (001111) |
| (0110) | × | × | ○ | × | × | ○ | (001001) |
| (0111) | ○ | ○ | × | × | ○ | ○ | (110011) |
| (1000) | ○ | ○ | ○ | ○ | ○ | ○ | (111111) |
| (1001) | ○ | × | × | × | × | ○ | (100001) |

FIRST DOT RECORDING SCHEME FOR k=4

SCAN PARAMETERS

| | |
|---|---|
| NOZZLE PITCH k | : 4 [DOT] |
| NUMBER OF NOZZLES N | : 8 |
| NUMBER OF SCAN REPEATS s | : 1 |
| NUMBER OF EFFECTIVE NOZZLES Neff | : 8 |

FIRST DOT RECORDING SCHEME FOR k=4

SCAN PARAMETERS

NOZZLE PITCH k : 4 [DOT]

NUMBER OF NOZZLES N : 8

NUMBER OF SCAN REPEATS s : 1

NUMBER OF EFFECTIVE NOZZLES Neff : 8

| NUMBER OF SUB-SCAN FEED | 0 | 1 | 2 | 3 | 4 |
|---|---|---|---|---|---|
| FEED AMOUNT L [dot] | 0 | 10 | 7 | 6 | 9 |
| ΣL | 0 | 10 | 17 | 23 | 32 |
| F = (ΣL) % k | 0 | 2 | 1 | 3 | 0 |

FIG. 15A

RASTER NUMBERS OF EFFECTIVE RASTER LINES RECORDED BY RESPECTIVE NOZZLES

NUMBER OF SUB-SCAN FEED

| NOZZLE | 0 | 1 | 2 | 3 | 4 | 5 | 6 | 7 |
|---|---|---|---|---|---|---|---|---|
| #0: | · | · | · | 4 | 13 | 23 | 30 | (36) |
| #1: | · | · | 2 | 8 | 17 | 27 | (34) | (40) |
| #2: | · | · | 6 | 12 | 21 | 31 | (38) | (44) |
| #3: | · | 3 | 10 | 16 | 25 | (35) | (42) | (48) |
| #4: | · | 7 | 14 | 20 | 29 | (39) | (46) | (52) |
| #5: | 1 | 11 | 18 | 24 | (33) | (43) | (50) | (56) |
| #6: | 5 | 15 | 22 | 28 | (37) | (47) | (54) | (60) |
| #7: | 9 | 19 | 26 | 32 | (41) | (51) | (58) | (64) |

FIG. 15B

NOZZLE NUMBERS FOR RECORDING RESPECTIVE RASTER LINES
(FIRST DOT RECORDING SCHEME FOR k=4)

| | | | NUMBER OF SUB-SCAN FEED | | | | | | |
|---|---|---|---|---|---|---|---|---|---|
| RASTER | @ | △ | 0 | 1 | 2 | 3 | 4 | 5 | 6 |
| 1 | · | – | #5 | | | | | | |
| 2 | × | 2 | · | · | #1 | | | | |
| 3 | · | – | · | #3 | | | | | |
| 4 | × | 3 | · | · | · | #0 | | | |
| 5 | · | – | #6 | | | | | | |
| 6 | × | 2 | · | · | #2 | | | | |
| 7 | · | – | · | #4 | | | | | |
| 8 | × | 3 | · | · | · | #1 | | | |
| 9 | · | – | #7 | | | | | | |
| 10 | × | 2 | · | · | #3 | | | | |
| 11 | · | – | · | #5 | · | | | | |
| 12 | ↑ | 2 | · | · | · | #2 | | | |
| 13 | × | 2 | · | · | · | · | #0 | | |
| 14 | ↓ | 1 | · | · | #4 | | | | |
| 15 | · | – | · | #6 | | | | | |
| 16 | ↑ | 2 | · | · | · | #3 | | | |
| 17 | × | 2 | · | · | · | · | #1 | | |
| 18 | ↓ | 1 | · | · | #5 | | | | |
| 19 | · | – | · | #7 | | | | | |
| 20 | ↑ | 2 | · | · | · | #4 | | | |
| 21 | × | 2 | · | · | · | · | #2 | | |
| 22 | · | – | · | · | #6 | | | | |
| 23 | × | 3 | · | · | · | · | · | #0 | |
| 24 | · | – | · | · | · | #5 | | | |
| 25 | × | 2 | · | · | · | · | #3 | | |
| 26 | · | – | · | · | #7 | | | | |
| 27 | × | 3 | · | · | · | · | · | #1 | |
| 28 | · | – | · | · | · | #6 | | | |
| 29 | ↑ | 1 | · | · | · | · | #4 | | |
| 30 | × | 2 | · | · | · | · | · | · | #0 |
| 31 | ↓ | – | · | · | · | · | · | #2 | |

FIG. 16

SECOND DOT RECORDING SCHEME FOR k=4

SCAN PARAMETERS

NOZZLE PITCH k : 4 [DOT]

NUMBER OF NOZZLES N : 8

NUMBER OF SCAN REPEATS s : 1

NUMBER OF EFFECTIVE NOZZLES Neff : 8

| NUMBER OF SUB-SCAN FEED | 0 | 1 | 2 | 3 | 4 |
|---|---|---|---|---|---|
| FEED AMOUNT L [dot] | 0 | 7 | 6 | 9 | 10 |
| ΣL | 0 | 7 | 13 | 22 | 32 |
| F = (ΣL) % k | 0 | 3 | 1 | 2 | 0 |

FIG. 17A

RASTER NUMBERS OF EFFECTIVE RASTER LINES RECORDED BY RESPECTIVE NOZZLES

NUMBER OF SUB-SCAN FEED

| NOZZLE | 0 | 1 | 2 | 3 | 4 | 5 | 6 | 7 |
|---|---|---|---|---|---|---|---|---|
| #0: | · | · | · | 4 | 14 | 21 | 27 | (36) |
| #1: | · | · | · | 8 | 18 | 25 | 31 | (40) |
| #2: | · | · | 3 | 12 | 22 | 29 | (35) | |
| #3: | · | 1 | 7 | 16 | 26 | (33) | | |
| #4: | · | 5 | 11 | 20 | 30 | (37) | | |
| #5: | 2 | 9 | 15 | 24 | (34) | | | |
| #6: | 6 | 13 | 19 | 28 | (38) | | | |
| #7: | 10 | 17 | 23 | 32 | (42) | | | |

FIG. 17B

NOZZLE NUMBERS FOR RECORDING RESPECTIVE RASTER LINES
(SECOND DOT RECORDING SCHEME FOR k=4)

| | | | NUMBER OF SUB-SCAN FEED | | | | | | |
|---|---|---|---|---|---|---|---|---|---|
| RASTER | @ | △ | 0 | 1 | 2 | 3 | 4 | 5 | 6 |
| 1 | ↓ | 1 | · | #3 | | | | | |
| 2 | · | – | #5 | | | | | | |
| 3 | ↑ | 2 | · | · | #2 | | | | |
| 4 | × | 2 | · | · | · | #0 | | | |
| 5 | ↓ | 1 | · | #4 | | | | | |
| 6 | · | – | #6 | | | | | | |
| 7 | ↑ | 2 | · | · | #3 | | | | |
| 8 | × | 2 | · | · | · | #1 | | | |
| 9 | ↓ | 1 | · | #5 | | | | | |
| 10 | · | – | #7 | | | | | | |
| 11 | ↑ | 2 | · | · | #4 | | | | |
| 12 | × | 2 | · | · | · | #2 | | | |
| 13 | · | – | · | #6 | | | | | |
| 14 | × | 3 | · | · | · | · | #0 | | |
| 15 | · | – | · | · | #5 | | | | |
| 16 | × | 2 | · | · | · | #3 | | | |
| 17 | · | – | · | #7 | | | | | |
| 18 | × | 3 | · | · | · | · | #1 | | |
| 19 | · | – | · | · | #6 | | | | |
| 20 | ↑ | 1 | · | · | · | #4 | | | |
| 21 | × | 2 | · | · | · | · | · | #0 | |
| 22 | ↓ | 2 | · | · | · | · | #2 | | |
| 23 | · | – | · | · | #7 | | | | |
| 24 | ↑ | 1 | · | · | · | #5 | | | |
| 25 | × | 2 | · | · | · | · | · | #1 | |
| 26 | · | – | · | · | · | · | #3 | | |
| 27 | × | 3 | · | · | · | · | · | · | #0 |
| 28 | · | – | · | · | · | #6 | | | |
| 29 | × | 2 | · | · | · | · | · | #2 | |
| 30 | · | – | · | · | · | · | #4 | | |
| 31 | × | 3 | · | · | · | · | · | · | #1 |
| 32 | · | – | · | · | · | #7 | | | |

FIG. 18

THIRD DOT RECORDING SCHEME FOR k=4

SCAN PARAMETERS

NOZZLE PITCH k : 4 [DOT]
NUMBER OF NOZZLES N : 7
NUMBER OF SCAN REPEATS s : 1
NUMBER OF EFFECTIVE NOZZLES Neff : 7

| NUMBER OF SUB-SCAN FEED | 0 | 1 | 2 | 3 | 4 |
|---|---|---|---|---|---|
| FEED AMOUNT L [dot] | 0 | 7 | 7 | 7 | 7 |
| ΣL | 0 | 7 | 14 | 21 | 28 |
| F = (ΣL) % k | 0 | 3 | 2 | 1 | 0 |

FIG. 19A

RASTER NUMBERS OF EFFECTIVE RASTER LINES RECORDED BY RESPECTIVE NOZZLES

NUMBER OF SUB-SCAN FEED

| NOZZLE | 0 | 1 | 2 | 3 | 4 | 5 | 6 | 7 |
|---|---|---|---|---|---|---|---|---|
| #0: | · | · | · | 4 | 11 | 18 | 25 | (32) |
| #1: | · | · | 1 | 8 | 15 | 22 | (29) | |
| #2: | · | · | 5 | 12 | 19 | 26 | (33) | |
| #3: | · | 2 | 9 | 16 | 23 | (30) | | |
| #4: | · | 6 | 13 | 20 | 27 | (34) | | |
| #5: | 3 | 10 | 17 | 24 | (31) | | | |
| #6: | 7 | 14 | 21 | 28 | (35) | | | |

FIG. 19B

NOZZLE NUMBERS FOR RECORDING RESPECTIVE RASTER LINES
(THIRD DOT RECORDING SCHEME FOR k=4)

| | | | NUMBER OF SUB-SCAN FEED | | | | | | | |
|---|---|---|---|---|---|---|---|---|---|---|
| RASTER | @ | △ | 0 | 1 | 2 | 3 | 4 | 5 | 6 | 7 |
| 1 | ↓ | 1 | · | · | #1 | | | | | |
| 2 | ↓ | 1 | · | #3 | | | | | | |
| 3 | · | – | #5 | | | | | | | |
| 4 | × | 3 | · | · | · | #0 | | | | |
| 5 | ↓ | 1 | · | · | #2 | | | | | |
| 6 | ↓ | 1 | · | #4 | | | | | | |
| 7 | · | – | #6 | | | | | | | |
| 8 | × | 3 | · | · | · | #1 | | | | |
| 9 | ↓ | 1 | · | · | #3 | | | | | |
| 10 | · | – | · | #5 | | | | | | |
| 11 | × | 3 | · | · | · | · | #0 | | | |
| 12 | ↓ | 1 | · | · | · | #2 | | | | |
| 13 | ↓ | 1 | · | · | #4 | | | | | |
| 14 | · | – | · | #6 | | | | | | |
| 15 | × | 3 | · | · | · | · | #1 | | | |
| 16 | ↓ | 1 | · | · | · | #3 | | | | |
| 17 | · | – | · | · | #5 | | | | | |
| 18 | × | 3 | · | · | · | · | · | #0 | | |
| 19 | ↓ | 1 | · | · | · | · | #2 | | | |
| 20 | ↓ | 1 | · | · | · | #4 | | | | |
| 21 | · | – | · | · | #6 | | | | | |
| 22 | × | 3 | · | · | · | · | · | #1 | | |
| 23 | ↓ | 1 | · | · | · | · | #3 | | | |
| 24 | · | – | · | · | · | #5 | | | | |
| 25 | × | 3 | · | · | · | · | · | · | #0 | |
| 26 | ↓ | 1 | · | · | · | · | · | #2 | | |
| 27 | ↓ | 1 | · | · | · | · | #4 | | | |
| 28 | · | – | · | · | · | #6 | | | | |
| 29 | × | 3 | · | · | · | · | · | · | #1 | |
| 30 | ↓ | 1 | · | · | · | · | · | #3 | | |
| 31 | · | – | · | · | · | · | #5 | | | |
| 32 | × | 3 | · | · | · | · | · | · | · | #0 |

FIG. 20

FOURTH DOT RECORDING SCHEME FOR k=4

SCAN PARAMETERS
NOZZLE PITCH k : 4 [DOT]
NUMBER OF NOZZLES N : 16
NUMBER OF SCAN REPEATS s : 2
NUMBER OF EFFECTIVE NOZZLES Neff : 8

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 10 | 7 | 6 | 9 | 10 | 7 | 6 | 9 |
| ΣL | 0 | 10 | 17 | 23 | 32 | 42 | 49 | 55 | 64 |
| F = (ΣL) % k | 0 | 2 | 1 | 3 | 0 | 2 | 1 | 3 | 0 |

FIG. 21A

FIFTH DOT RECORDING SCHEME FOR k=4

SCAN PARAMETERS
NOZZLE PITCH k : 4 [DOT]
NUMBER OF NOZZLES N : 16
NUMBER OF SCAN REPEATS s : 2
NUMBER OF EFFECTIVE NOZZLES Neff : 8

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 7 | 6 | 9 | 10 | 7 | 6 | 9 | 10 |
| ΣL | 0 | 7 | 13 | 22 | 32 | 39 | 45 | 54 | 64 |
| F = (ΣL) % k | 0 | 3 | 1 | 2 | 0 | 3 | 1 | 2 | 0 |

FIG. 21B

SIXTH DOT RECORDING SCHEME FOR k=4

SCAN PARAMETERS
NOZZLE PITCH k : 4 [DOT]
NUMBER OF NOZZLES N : 14
NUMBER OF SCAN REPEATS s : 2
NUMBER OF EFFECTIVE NOZZLES Neff : 7

| NUMBER OF SUB-SCAN FEED | 0 | 1 | 2 | 3 | 4 | 5 | 6 | 7 | 8 |
|---|---|---|---|---|---|---|---|---|---|
| FEED AMOUNT L [dot] | 0 | 7 | 7 | 7 | 7 | 7 | 7 | 7 | 7 |
| ΣL | 0 | 7 | 14 | 21 | 28 | 35 | 42 | 49 | 56 |
| F = (ΣL) % k | 0 | 3 | 2 | 1 | 0 | 3 | 2 | 1 | 0 |

FIG. 21C

SCAN PARAMETERS OF FIRST DOT RECORDING SCHEME FOR k=6

NOZZLE PITCH k : 4 [DOT], NUMBER OF SCAN REPEATS s : 2
NUMBER OF NOZZLES N : 48 , NUMBER OF EFFECTIVE NOZZLES Neff : 24

| NUMBER OF SUB-SCAN FEED | 0 | 1 | 2 | 3 | 4 | 5 | 6 |
|---|---|---|---|---|---|---|---|
| FEED AMOUNT L [dot] | 0 | 20 | 27 | 22 | 28 | 21 | 26 |
| ΣL | 0 | 20 | 47 | 69 | 97 | 118 | 144 |
| F = (ΣL) % k | 0 | 2 | 5 | 3 | 1 | 4 | 0 |

FIG. 22A

SCAN PARAMETERS OF SECOND DOT RECORDING SCHEME FOR k=6

NOZZLE PITCH k : 4 [DOT], NUMBER OF SCAN REPEATS s : 2
NUMBER OF NOZZLES N : 48 , NUMBER OF EFFECTIVE NOZZLES Neff : 24

| NUMBER OF SUB-SCAN FEED | 0 | 1 | 2 | 3 | 4 | 5 | 6 |
|---|---|---|---|---|---|---|---|
| FEED AMOUNT L [dot] | 0 | 27 | 26 | 20 | 21 | 22 | 28 |
| ΣL | 0 | 27 | 63 | 73 | 94 | 116 | 144 |
| F = (ΣL) % k | 0 | 3 | 5 | 1 | 4 | 2 | 0 |

FIG. 22B

SCAN PARAMETERS OF THIRD DOT RECORDING SCHEME FOR k=6

NOZZLE PITCH k : 6 [DOT], NUMBER OF SCAN REPEATS s : 2
NUMBER OF NOZZLES N : 47 , NUMBER OF EFFECTIVE NOZZLES Neff : 23.5

| NUMBER OF SUB-SCAN FEED | 0 | 1 | 2 | 3 | 4 | 5 | 6 |
|---|---|---|---|---|---|---|---|
| FEED AMOUNT L [dot] | 0 | 21 | 26 | 21 | 26 | 21 | 26 |
| ΣL | 0 | 21 | 47 | 68 | 94 | 115 | 141 |
| F = (ΣL) % k | 0 | 3 | 5 | 2 | 4 | 1 | 3 |
| NUMBER OF SUB-SCAN FEED | | 7 | 8 | 9 | 10 | 11 | 12 |
| FEED AMOUNT L [dot] | | 21 | 26 | 21 | 26 | 21 | 26 |
| ΣL | | 162 | 188 | 209 | 235 | 256 | 282 |
| F = (ΣL) % k | | 0 | 2 | 5 | 1 | 4 | 0 |

FIG. 22C

SCAN PARAMETERS OF FOURTH DOT RECORDING SCHEME FOR k=6

NOZZLE PITCH k : 6 [DOT], NUMBER OF SCAN REPEATS s : 2
NUMBER OF NOZZLES N : 47 , NUMBER OF EFFECTIVE NOZZLES Neff : 23.5

| NUMBER OF SUB-SCAN FEED | 0 | 1 | 2 | 3 | 4 | 5 | 6 |
|---|---|---|---|---|---|---|---|
| FEED AMOUNT L [dot] | 0 | 15 | 32 | 15 | 32 | 15 | 32 |
| ΣL | 0 | 15 | 47 | 62 | 94 | 109 | 141 |
| F = (ΣL) % k | 0 | 3 | 5 | 2 | 4 | 1 | 3 |
| NUMBER OF SUB-SCAN FEED | | 7 | 8 | 9 | 10 | 11 | 12 |
| FEED AMOUNT L [dot] | | 15 | 32 | 15 | 32 | 15 | 32 |
| ΣL | | 156 | 188 | 203 | 235 | 250 | 282 |
| F = (ΣL) % k | | 0 | 2 | 5 | 1 | 4 | 0 |

FIG. 22D

LIQUID JETTING APPARATUS

FIELD OF THE INVENTION

This invention relates to a liquid jetting apparatus, in particular to an ink-jet recording apparatus that can achieve recording of high image-quality mode at a relatively high speed.

BACKGROUND OF THE INVENTION

In a conventional ink-jet recording apparatus (an example of liquid jetting apparatus), ink (an example of liquid) is jetted from one nozzle for one picture element (one jetting unit area). A volume of the ink jetted from the nozzle is controlled by driving an ink jetting unit (an example of liquid jetting unit) such as a piezoelectric vibrating element provided at a pressure generating chamber communicated with the nozzle with a suitable operating signal.

In addition, in order to position the nozzle with respect to each picture element, a recording head having the nozzle is usually caused to scan in a straight direction with respect to a recording medium (main scan). The recording medium is usually caused to scan in a direction perpendicular to the moving direction (main scanning direction) of the recording head (sub scan).

In order to improve an efficiency of the recording, it is preferable that nozzles are formed in a row in the sub scanning direction. For example, when n nozzles are formed in a row, recording for n raster lines (main scanning lines) can be carried out in one main scan.

Actually, in order to improve image quality of the recording, partly, main scans are overlapped for each raster line in such a manner that a plurality of nozzles pass over each raster line. For example, if a main scan is repeated in a condition shifted downward by n/2 nozzles with respect to the previous main scan, two nozzles can pass over each raster line (however, regarding upper n/2 lines of n raster lines over which nozzles pass at the first main scan and lower n/2 lines of n raster lines over which nozzles pass at the last main scan, only one nozzle can pass over there).

In the case, recording for the same picture element can be carried out by different nozzles. Thus, deterioration of the image quality, which may be caused by positional errors of the nozzles and/or feeding errors during the main scans and the sub scans, can be reduced.

Japanese Patent Laid-Open Publn. No.10-337864 explains in detail that the image quality may be improved more effectively by suitably selecting a sub-scan feed amount.

If ink jetting for the same picture element can be carried out from different nozzles during partly overlapped main scans in order to improve the image quality, recording speed may be lowered by the overlap of the main scans.

SUMMARY OF THE INVENTION

The object of this invention is to solve the above problems, that is, to provide a liquid jetting apparatus that can jet liquid with a high quality and at a high speed, such as an ink-jet recording apparatus that can achieve recording with a high image quality and at a high speed, by reducing partial overlap of main scans as much as possible.

The invention is a liquid jetting apparatus comprising: a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row; a liquid jetting unit provided at each of the nozzles, the liquid jetting unit causing each of the nozzles to jet the liquid; a holding unit that holds a recording medium; a main scanning unit that causes the head member to move in a main scanning direction relatively to the recording medium; a sub scanning unit that causes the head member to move in a sub scanning direction perpendicular to the main scanning direction relatively to the recording medium; and a controlling unit connected to the liquid jetting unit and the main scanning unit; wherein: there is a slight gap between a moving track of a first nozzle by the main scanning unit and a moving track of a second nozzle paired with the first nozzle by the main scanning unit; and the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

According to the invention, since the liquid jetting from the first nozzle and the liquid jetting from the second nozzle paired with the first nozzle are carried out in the same main scan, even if main scans are not repeated, liquid jetting from the two nozzles for the same jetting unit area can be carried out.

In addition, a feature of the invention is that there is the slight gap between the moving track of the first nozzle by the main scanning unit and the moving track of the second nozzle paired with the first nozzle by the main scanning unit. The inventor has found that the beauty on the eye is better when positively adopting the slight gap of the moving tracks than when making the moving tracks to coincide completely.

Preferably, the plurality of first nozzles are formed at substantially regular intervals, the plurality of second nozzles are formed at substantially regular intervals, the intervals between the first nozzles and the intervals between the second nozzles are identical, a number of the first nozzles and a number of the second nozzles are identical so that each of the first nozzles and each of the second nozzles are paired with each other, and the slight gap is less than half or half of an interval of the nozzles in the sub scanning direction.

It is preferable that a volume of the liquid jetted from each of the nozzles at a time is 4 pl or less.

In addition, the controlling unit is also connected to the sub scanning unit, and is adapted to control the liquid jetting unit, the main scanning unit and the sub scanning unit based on a recording mode defined by a sub scan feed amount and information about used nozzles in a main scan. In the case, it is preferable that a recording mode storing unit that stores a plurality of recording modes, and a selecting unit that selects a suitable recording mode among the plurality of recording modes stored in the recording mode storing unit, are provided.

In the case, a control for each pair of nozzles consisting of a first nozzle and a second nozzle paired with the first nozzle can be achieved based on a suitable recording mode.

For example, the liquid supplying unit has a first liquid supplying way and a second liquid supplying way that are adapted to supply the same kind of liquid and that are substantially parallel with each other, the plurality of first nozzles are communicated with the first liquid supplying way, and the plurality of second nozzles are communicated with the second liquid supplying way.

In the case, the head member may be provided with a third liquid supplying way, a fourth liquid supplying way, a plurality of third nozzles communicated with the third liquid supplying way, and a plurality of fourth nozzles communicated with the fourth liquid supplying way, the third liquid supplying way and the fourth liquid supplying way being adjacent to the first liquid supplying way and the second liquid supplying way, being adapted to supply a same kind of liquid and being substantially parallel with each other. In the case, a second liquid jetting unit may be provided at each of the third nozzles and the fourth nozzles for causing each of the third nozzles and the fourth nozzles to jet the liquid. Then, the controlling unit may be also connected to the second liquid jetting unit, and may control the liquid jetting unit and the main scanning unit in such a manner that there is a slight gap between a moving track of a third nozzle by the main scanning unit and a moving track of a fourth nozzle paired with the third nozzle by the main scanning unit, and in such a manner that a liquid jetting from the third nozzle and a liquid jetting from the fourth nozzle paired with the third nozzle are carried out in a same main scan, based on jetting data for a same jetting unit area.

Alternatively, the head member may be provided with a third liquid supplying way, a fourth liquid supplying way, a plurality of third nozzles communicated with the third liquid supplying way, and a plurality of fourth nozzles communicated with the fourth liquid supplying way, the third liquid supplying way being formed between the first liquid supplying way and the second liquid supplying way, the fourth liquid supplying way being adjacent to the second liquid supplying way, the third liquid supplying way and the fourth liquid supplying way being adapted to supply a same kind of liquid. In the case, a second liquid jetting unit may be provided at each of the third nozzles and the fourth nozzles for causing each of the third nozzles and the fourth nozzles to jet the liquid. Then, the controlling unit may be also connected to the second liquid jetting unit, and may control the liquid jetting unit and the main scanning unit in such a manner that there is a slight gap between a moving track of a third nozzle by the main scanning unit and a moving track of a fourth nozzle paired with the third nozzle by the main scanning unit, and in such a manner that a liquid jetting from the third nozzle and a liquid jetting from the fourth nozzle paired with the third nozzle are carried out in a same main scan, based on jetting data for a same jetting unit area.

The paired first nozzle row and second nozzle row may be formed in different recording heads, respectively. That is, the invention is a liquid jetting apparatus comprising: a first head member having a plurality of first nozzles and a liquid supplying unit that supplies a liquid to each of the plurality of first nozzles, the plurality of first nozzles forming a first nozzle row; a second head member having a plurality of second nozzles and a liquid supplying unit that supplies a same kind of liquid as the liquid supplied to each of the plurality of first nozzles to each of the plurality of second nozzles, the plurality of second nozzles forming a second nozzle row that is paired with the first nozzle row; a liquid jetting unit provided at each of the nozzles, the liquid jetting unit causing each of the nozzles to jet the liquid; a holding unit that holds a recording medium; a main scanning unit that causes the respective head members to move in a main scanning direction relatively to the recording medium; a sub scanning unit that causes the respective head members to move in a sub scanning direction perpendicular to the main scanning direction relatively to the recording medium; and a controlling unit connected to the liquid jetting unit and the main scanning unit; wherein: there is a slight gap between a moving track of a first nozzle by the main scanning unit and a moving track of a second nozzle paired with the first nozzle by the main scanning unit; and the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

In addition, the liquid jetting unit may be able to cause the first nozzle to jet a or plural first liquid drops and the second nozzle to jet a or plural second liquid drops each of which has substantially the same volume as the first liquid drop. Alternatively, the liquid jetting unit may be able to cause the first nozzle to jet a first liquid drop and the second nozzle to jet a second liquid drop that has a volume different from that of the first liquid drop.

In addition, the invention is a controlling unit for controlling a liquid jetting apparatus including: a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row; a liquid jetting unit provided at each of the nozzles, the liquid jetting unit causing each of the nozzles to jet the liquid; a holding unit that holds a recording medium; a main scanning unit that causes the head member to move in a main scanning direction relatively to the recording medium; and a sub scanning unit that causes the head member to move in a sub scanning direction perpendicular to the main scanning direction relatively to the recording medium;

the controlling unit being: adapted to control the main scanning unit in such a manner that there is a slight gap between a moving track of a first nozzle and a moving track of a second nozzle paired with the first nozzle; and adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

Preferably, the controlling unit is adapted to control the liquid jetting unit in such a manner that the liquid jetting unit causes the first nozzle to jet a or plural first liquid drops and the second nozzle to jet a or plural second liquid drops each of which has a substantially same volume as the first liquid drop.

Alternatively, preferably, the controlling unit is adapted to control the liquid jetting unit in such a manner that the liquid jetting unit causes the first nozzle to jet a first liquid drop and the second nozzle to jet a second liquid drop that has a volume different from that of the first liquid drop.

The above respective controlling units can be materialized by a computer system. A program for materializing the respective controlling units in the computer system, and a storage medium storing the program capable of being read by a computer, should be protected by the application as well.

BRIEF DESCRIPTION OF THE DRAWINGS

FIGS. 15A and 15B are explanatory views showing scan parameters and raster numbers of effective raster lines recorded by respective nozzles, in the first recording mode for k=4;

FIG. 16 is an explanatory view showing nozzle numbers for recording the effective raster lines in the first recording mode for k=4;

FIGS. 17A and 17B are explanatory views showing scan parameters and raster numbers of effective raster lines recorded by respective nozzles, in the second recording mode for k=4;

FIG. 18 is an explanatory view showing nozzle numbers for recording the effective raster lines in the second recording mode for k=4;

FIGS. 19A and 19B are explanatory views showing scan parameters and raster numbers of effective raster lines recorded by respective nozzles, in the third recording mode for k=4;

FIG. 20 is an explanatory view showing nozzle numbers for recording the effective raster lines in the third recording mode for k=4;

FIGS. 21A to 21C are explanatory views showing scan parameters in the fourth to sixth recording mode for k=4;

FIGS. 22A to 22D are explanatory views showing scan parameters in the first to fourth recording mode for k=6;

BEST MODE FOR CARRYING OUT THE INVENTION

Embodiments of the invention will now be described with reference to drawings.

Figure 1:
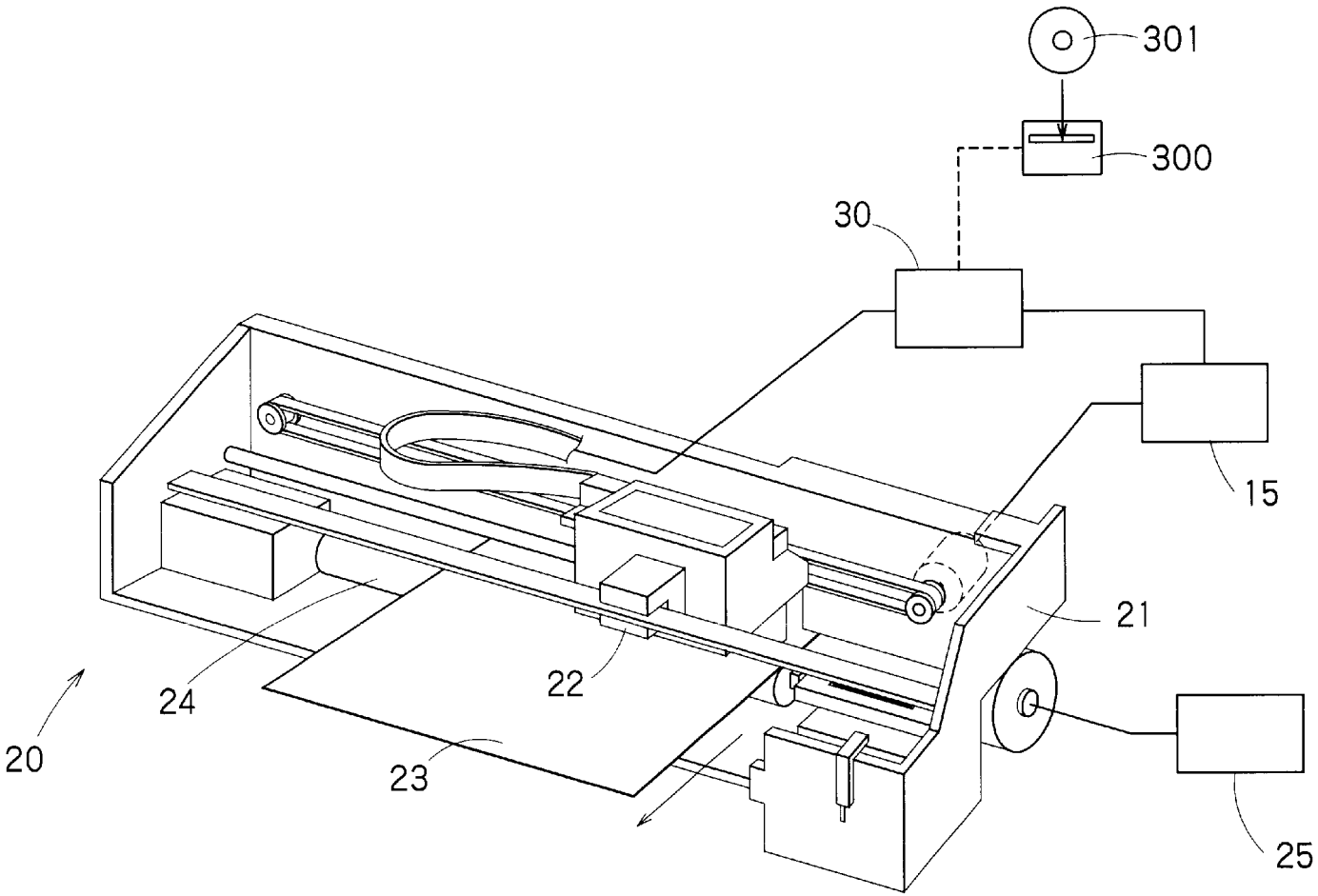
FIG. 1 is a schematic view of a first embodiment of an ink-jet recording apparatus according to the invention.

FIG. 1 is a schematic view of a first embodiment of an ink-jet recording apparatus (an example of liquid jetting apparatus) according to the invention. As shown in FIG. 1, the ink-jet recording apparatus 20 of the first embodiment of the invention comprises a frame 21 and a recording head 22 (head member) supported in the frame 21 in a reciprocatable manner, and a supporting mechanism 24 that supports a recording medium 23 in such a manner that the recording medium 23 is movable in a direction (sub scanning direction) perpendicular to the moving direction (main scanning direction) of the recording head 22.

The recording head 22 is connected to a main scan controlling unit 15 that causes the recording head 22 to move in the main scanning direction relatively to the recording medium 23.

On the other hand, the supporting mechanism 24 is connected to a sub scan controlling unit 25 that causes the recording medium 23 to move in the sub scanning direction relatively to the recording head 22.

Figure 2:
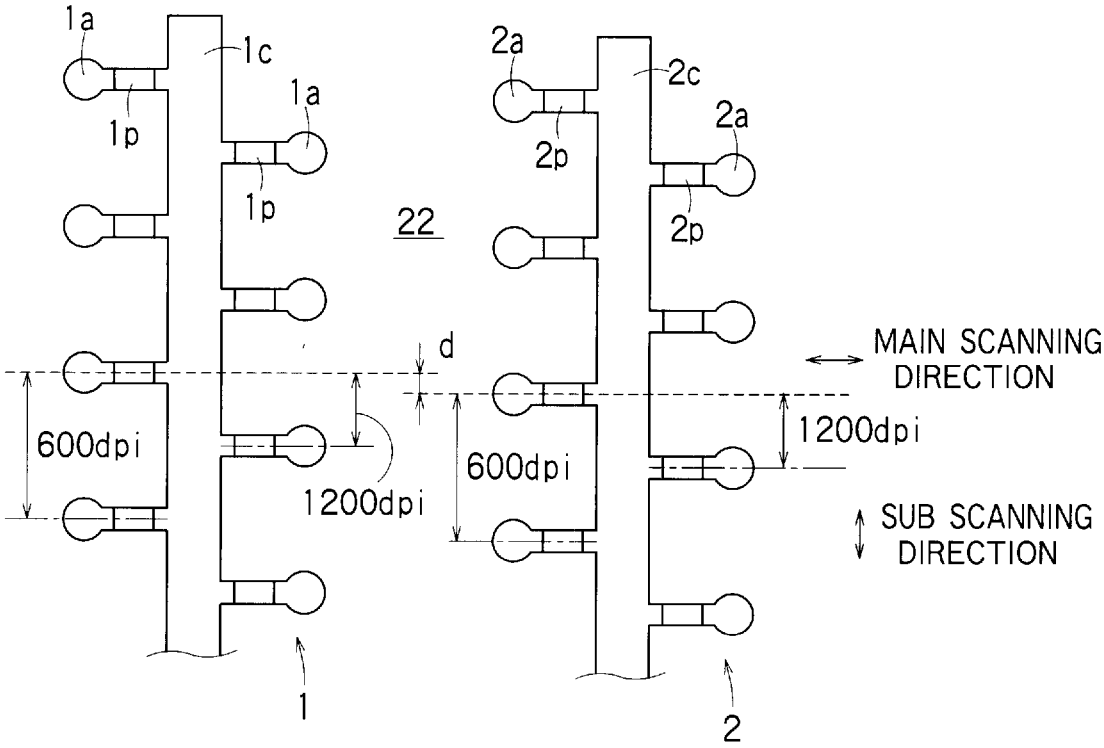
FIG. 2 is a schematic view of a recording head shown in FIG. 1.

FIG. 2 is a schematic partial view of the recording head 22. As shown in FIG. 2, the recording head 22 has a plurality of first nozzles 1*a* forming a first nozzle row 1, a plurality of second nozzles 2*a* forming a second nozzle row 2 that is paired with the first nozzle row 1, and an ink supplying unit (liquid supplying unit) that supplies the same ink (liquid) to each of the nozzles 1*a* and 2*a*.

In the case, the ink supplying unit has a first ink supplying way 1*c* and a second ink supplying way 2*c* that are connected to the same ink cartridge, adapted to supply the same ink and substantially parallel with each other. Each of the first nozzles 1*a* is communicated with the first ink supplying way 1*c*, and each of the second nozzles 2*a* is communicated with the second ink supplying way 2*c*.

In addition, the plurality of first nozzles 1*a* are arranged in a cross-stitch manner across the first ink supplying way 1*c*, and the plurality of second nozzles 2*a* are arranged in a cross-stitch manner across the second ink supplying way 2*c*. Thus, both the first nozzle row 1 and the second nozzle row 2 extend in the cross-stitch manners.

As shown in FIG. 2, the plurality of first nozzles 1*a* are formed at substantially regular intervals. Similarly, the plurality of second nozzles 2*a* are formed at substantially regular intervals. In addition, the intervals between the first nozzles 1*a* and the intervals between the second nozzles 2*s* are identical.

Each interval of the nozzles 1*a*, 2*a* in the sub scanning direction is 1200 dpi. Such an interval can be achieved by adopting the above cross-stitch arrangement. An interval of alternate aligning nozzles 1*a*, 2*a* is 600 dpi. Herein, all straight rows formed by the alternate nozzles 1*a*, 2*a* extend in the sub scanning direction.

In addition, a number of the first nozzles 1*a* and a number of the second nozzles 2*a* are identical so that each of the first nozzles 1*a* and each of the second nozzles 2*a* are paired with each other. Each of the second nozzles 2*a* is formed at a position shifted by a slight distance d in the sub scanning direction from each of the first nozzles 1*a* paired therewith. That is, there is a slight gap d between a moving track of the first nozzle 1*a* by the main scan controlling unit 15 and a moving track of the second nozzle 2*a* paired with the first nozzle 1*a* by the main scan controlling unit 15.

An ink jetting unit 1*p*, 2*p* is provided at each of the nozzles 1*a*, 2*a* for causing each of the nozzles 1*a*, 2*a* to jet the ink. In the case, each ink jetting unit 1*p*, 2*p* is formed by a piezoelectric vibrating member provided at a pressure generating chamber communicated with each of the nozzles 1*a*, 2*a*.

In addition, a jet-distribution controlling unit 30 is connected to the ink jetting units 1*p*, 2*p* and the main scan controlling unit 15. The jet-distribution controlling unit 30 is adapted to control the ink jetting units 1*p*, 2*p* and the main scan controlling unit 15 in such a manner that both an ink jetting from a first nozzle 1*a* and an ink jetting from a second nozzle 2*a* paired with the first nozzle 1*a* are carried out in the same main scan for the same picture element (jetting unit area).

Preferably, the jet-distribution controlling unit 30 sets a volume of the ink jetted from each of the nozzles 1*a*, 2*a* at a time to be 4 pl or less.

Figure 3:
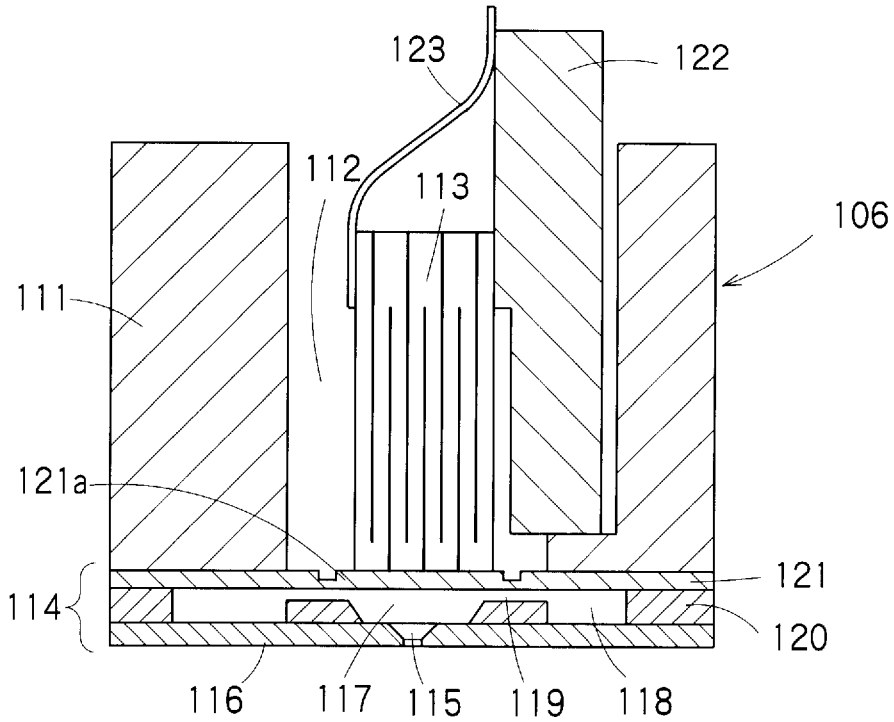
FIG. 3 is a schematic view of an ink jetting unit formed by a piezoelectric vibrating element.

The jet-distribution controlling unit 30 can be materialized by for example a computer system. In detail, it can be materialized for example by causing a storage medium 301, which is capable of being read by a computer and stores a program for materializing the jet-distribution controlling unit 30 in the computer system, to be read by a storage-medium reading unit 300 of the computer system FIG. 3 is a schematic view of an ink jetting unit formed by a piezoelectric vibrating element. A recording head 106 shown in FIG. 3 comprises: a base stage 111, a piezoelectric vibrating element 113 vibratably contained in a containing room 112 of the base stage 111 as an ink jetting unit, and a flow-way unit 114 fixed on an under surface of the base stage 111.

The flow-way unit 114 consists of a nozzle plate 116 in which a nozzle 115 is punched, a thin vibrating plate 121 that can be elastically deformed, and a flow-way forming plate 120 sealingly fixed between the nozzle plate 116 and the vibrating plate 121. The flow-way forming plate 120 is provided with a pressure generating chamber 117 that is communicated with the nozzle 115, an ink chamber 118 to which an ink is supplied from an ink cartridge, and a space corresponding to an ink supplying way 119 through which the ink is supplied from the ink chamber 118 to the pressure generating chamber 117.

The piezoelectric vibrating member 113 is attached on a supporting plate 122, which is fixed in the containing room 112 of the base stage 111. Thus, the piezoelectric vibrating member 113 is vibratably contained in the containing room 112. A lower end of the piezoelectric vibrating member 113 is adhesively joined with an island portion 121*a* of the vibrating plate 121 of the flow-way unit 114. In the drawing, 123 represents a signal cable for sending a driving signal to the piezoelectric vibrating member 113.

In the above recording head 106, for example, a printing operation can be conducted as follows. That is, at first, when the piezoelectric vibrating member 113 is charged and contracted, the pressure generating chamber 117 expands to decrease a pressure therein. Thus, a meniscus formed at the nozzle 115 is contracted a little toward the pressure generating chamber 117, and the ink in the ink chamber 118 is supplied to the pressure generating chamber 117 through the ink supplying way 119.

Then, after a predetermined time has passed, when electric charges of the piezoelectric vibrating member 113 are so discharged that the piezoelectric vibrating member 113 is returned to its original state, the pressure generating chamber 117 contracts to increase the pressure therein. Thus, the ink in the pressure generating chamber 117 is so compressed that the ink is jetted as an ink drop from the nozzle 115 to an upper surface of the recording medium, so that images and letters are printed.

Figure 4:
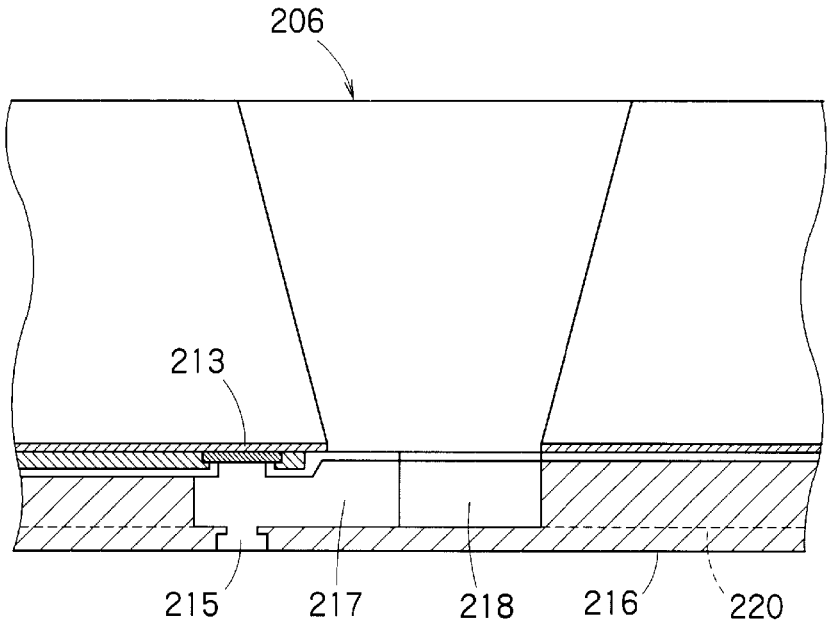
FIG. 4 is a schematic view of an ink jetting unit formed by a heater.

On the other hand, FIG. 4 is a schematic view of an ink jetting unit formed by a heater. A recording head 206 shown in FIG. 4 has a nozzle plate 216 in which a nozzle 215 is punched, and a flow-way forming plate 220 sealingly fixed on the nozzle plate 216. The flow-way forming plate 220 is provided with a pressure generating chamber 217 that is communicated with the nozzle 215, and an ink chamber 218 to which an ink is supplied from an ink cartridge.

A heater 213 as an ink jetting unit is attached on an upper surface of the pressure generating chamber 217.

In the above recording head 206, for example, a printing operation can be conducted as follows. That is, at first, when the heater 213 is charged to generate a heat, an air bubble is generated in the ink in the pressure generating chamber 217. A size of the air bubble may be controlled by controlling a temperature of the heater 213. Thus, a pressure of the ink in the pressure generating chamber 217 is controlled so that an ink drop is suitably jetted from the nozzle 215.

Next, an operation of the above embodiment is explained.

At first, a recording medium 23 such as a recording paper is supported by the supporting mechanism 24, and suitably moved and positioned in the sub scanning direction.

While the recording head 22 moves in the main scanning direction, each ink jetting unit 1*p*, 2*p* is controlled so that an ink drop is jetted from each nozzle 1*a*, 2*a* for a desired picture-element area of the recording medium 23.

At that time, by means of the jet-distribution controlling unit 30, based on image data (jetting data) for the same picture element, an ink jetting from the first nozzle 1*a* and an ink jetting from the second nozzle 2*a* paired with the first nozzle 1*a* are carried out in the same main scan for the same picture element (the same jetting unit area) although having a slight gap. In the case, if a volume of the ink jetted from each of the nozzles 1*a*, 2*a* is 4 pl, 8 pl of ink drops is jetted from the paired two nozzles.

As described above, according to the embodiment, the ink jetting from the first nozzle 1*a* and the ink jetting from the second nozzle 2*a* paired with the first nozzle 1*a* are carried out for the same picture element in the one main scan. Since the ink jetting for the one picture element is carried out by the plurality of nozzles 1*a*, 2*a*, printing with high quality can be achieved. In addition, since the main scan is not repeated, printing at a high speed can be achieved.

Figure 5:
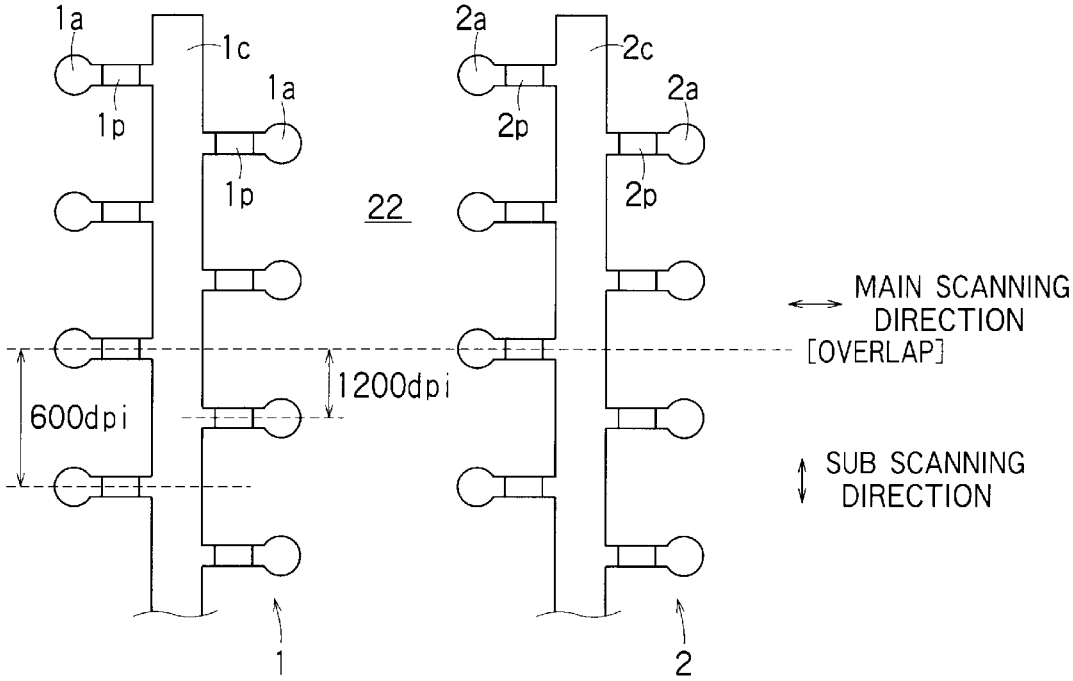
FIG. 5 is a schematic view of a recording head for comparison.

In the embodiment, there is a slight gap d between a moving track of a first nozzle 1*a* by the main scan controlling unit 15 and a moving track of a second nozzle 2*a* paired with the first nozzle 1*a* by the main scan controlling unit 15. It has been confirmed that the beauty of printed image on the eye is better when positively adopting the slight gap between the moving tracks than when there is no slight gap as shown in FIG. 5.

The slight gap d can theoretically reach half of an interval (1200 dpi) between the nozzles 1*a* or 2*a* in the sub scanning direction. When the slight gap d is equal to the half of the interval between the nozzles 1*a* or 2*a* in the sub scanning direction, the nozzles 1*a* and 2*a* are arranged in a four-step cross-stitch manner. Nevertheless, the feature of the embodiment is that the ink jetting from the second nozzle 2*a* is carried out in connection with the ink jetting from the first nozzle 1*a* paired with the second nozzle 2*a* in the same main scan.

A suitable slight gap d is for example about 1/4800 inch. Alternatively, a slight gap d can be determined based on an impact diameter of the ink drop. For example, a suitable slight gap d is about ½ of the smallest impact diameter (dot diameter).

In addition, in the embodiment, the plurality of first nozzles 1*a* are arranged in a cross-stitch manner across the first ink supplying way 1*c*, and the plurality of second nozzles 2*a* are arranged in a cross-stitch manner across the second ink supplying way 2*c*. That is, the first nozzles 1*a* and the second nozzles 2*a* are arranged very densely. Thus, printing with very high image quality can be achieved.

In addition, if a volume of the ink jetted from each of the nozzles 1*a*, 2*a* at a time is 4 pl or less, printing with very high image quality can be achieved.

Furthermore, the jet-distribution controlling unit 30 can change the volume of the ink jetted from each of the nozzles 1*a*, 2*a* at a time based on the recording data or based on ink properties, in stead of setting the same volume. Timing of the ink jetting from each of the nozzles 1*a*, 2*a* can vary according to the volume of the ink jetted therefrom. A method of adjusting the jetting timing based on the volume of the ink to be jetted is described in Japanese Patent application No. 11-350622 by the inventors.

Each ink jetting from each of the nozzles 1*a*, 2*a* can be conducted according to a controlling method wherein a two-bit signal is used for each picture element: when the signal is "11", ink jetting is conducted from both of the paired nozzles; when the signal is "10", ink jetting is conducted from only the first nozzle 1*a*; when the signal is "01", ink jetting is conducted from only the second nozzle 2*a*; when the signal is "00", ink jetting is conducted from none of paired nozzles.

Each ink jetting from each of the nozzles 1*a*, 2*a* can be conducted independently. For example, in order to carry out the ink jetting, a common driving signal can be used for ink jetting from the first nozzles 1*a* and the second nozzles 2*a*, while changing a selecting signal for each of the nozzles.

Figure 6:
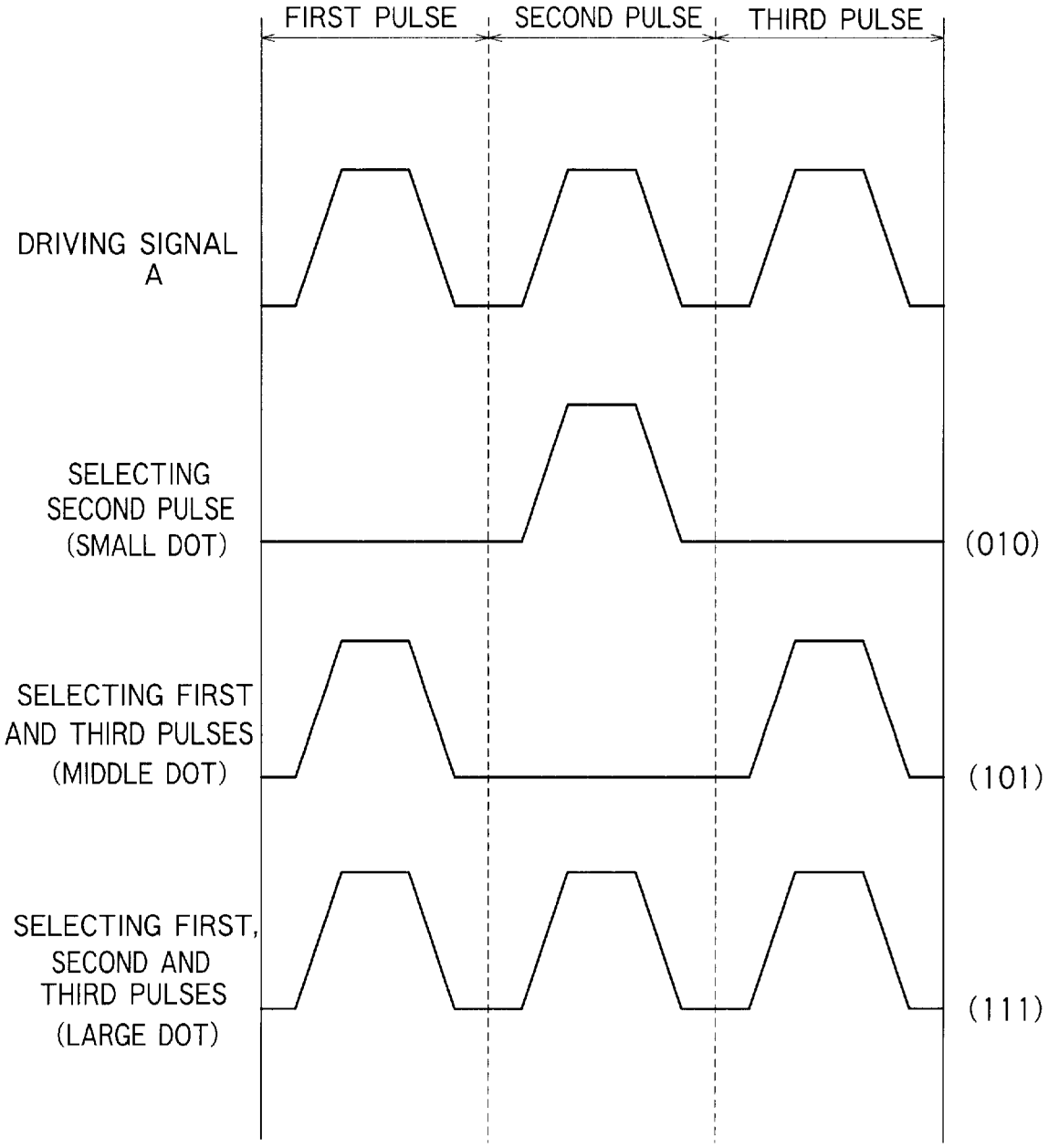
FIG. 6 is an explanatory view of an example of driving signal of ink-jetting.

For example, a driving signal A as shown in FIG. 6 is used as a common driving signal, and pulse selecting signals (010), (101) and (111), which correspond to a small dot, a middle dot and a large dot respectively, are used in order to independently control the numbers of small ink drops jetted from the first nozzle 1*a* and the second nozzle 2*a*, respectively (if small, the number is 1; if middle, the number is 2; if large, the number is 3). Thus, the ink jetting from each of the nozzles can have three gradations.

Figure 7:
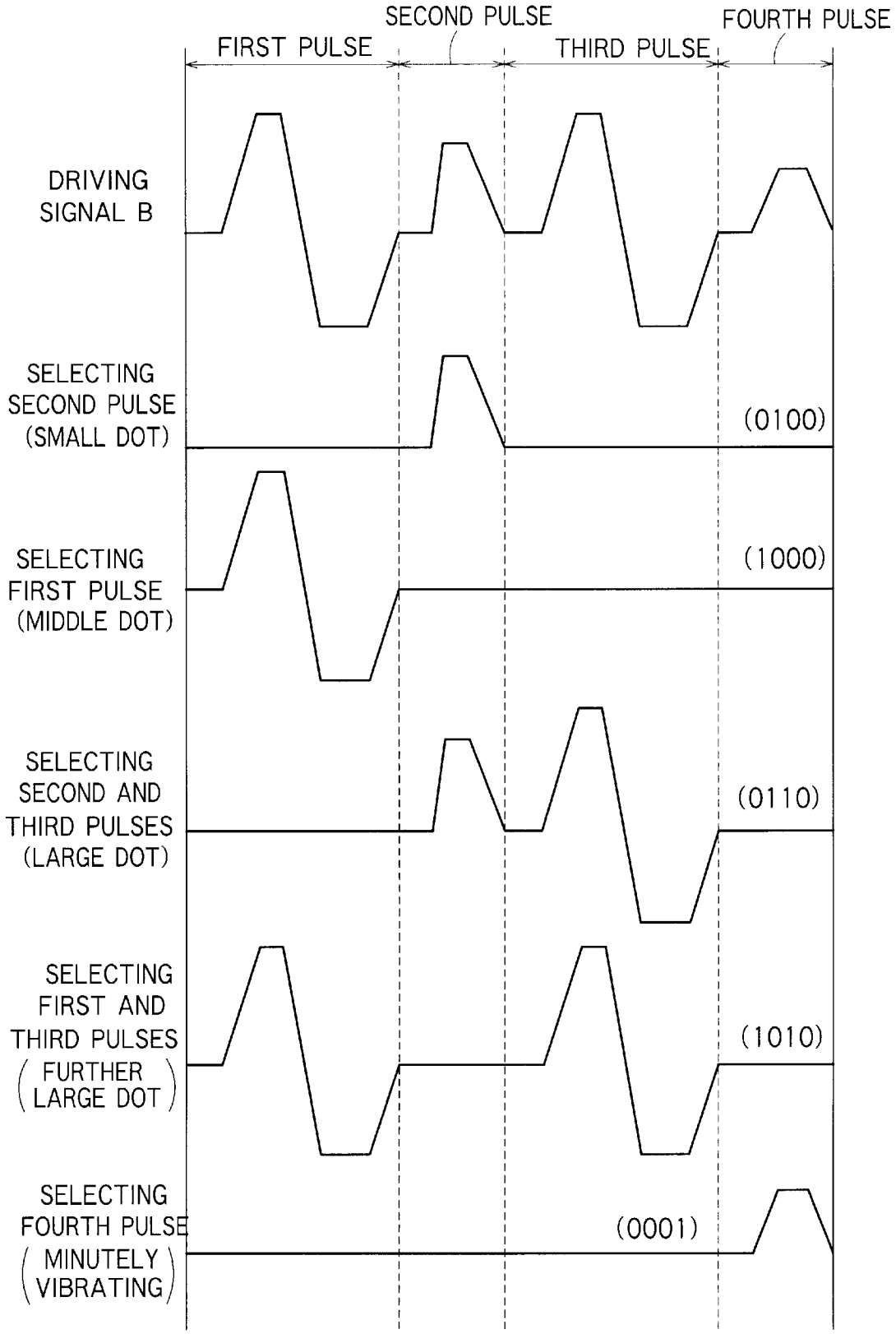
FIG. 7 is an explanatory view of an example of driving signal of ink-jetting.

Alternatively, a driving signal B as shown in FIG. 7 is used as a common driving signal, and pulse selecting signals (0100), (1000), (0110) and (1010), which correspond to a small dot, a middle dot, a large dot and a further large dot respectively, are used in order to independently control volumes and the numbers of ink drops jetted from the first nozzle 1*a* and the second nozzle 2*a*, respectively. Thus, the ink jetting from each of the nozzles can have four gradations.

Figures 8A, 8B:
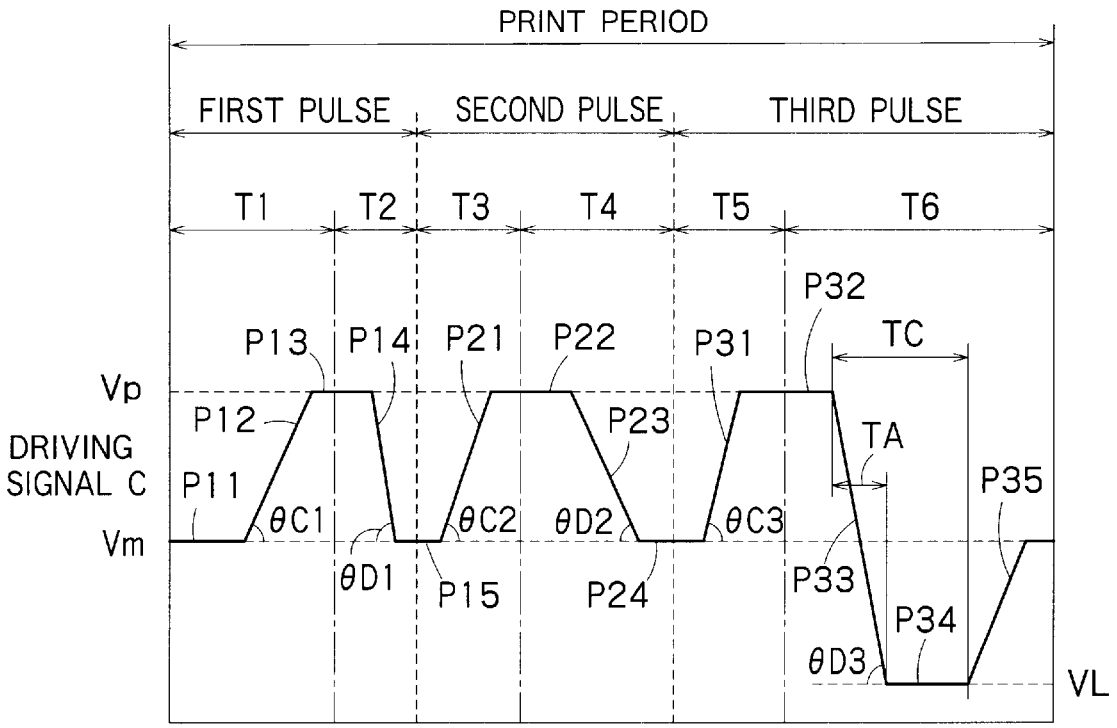
FIG. 8A is an explanatory view of an example of common driving signal for ink-jetting.
FIG. 8B is an explanatory view of decode values for the common driving signal shown in FIG. 8A.
Figure 9:
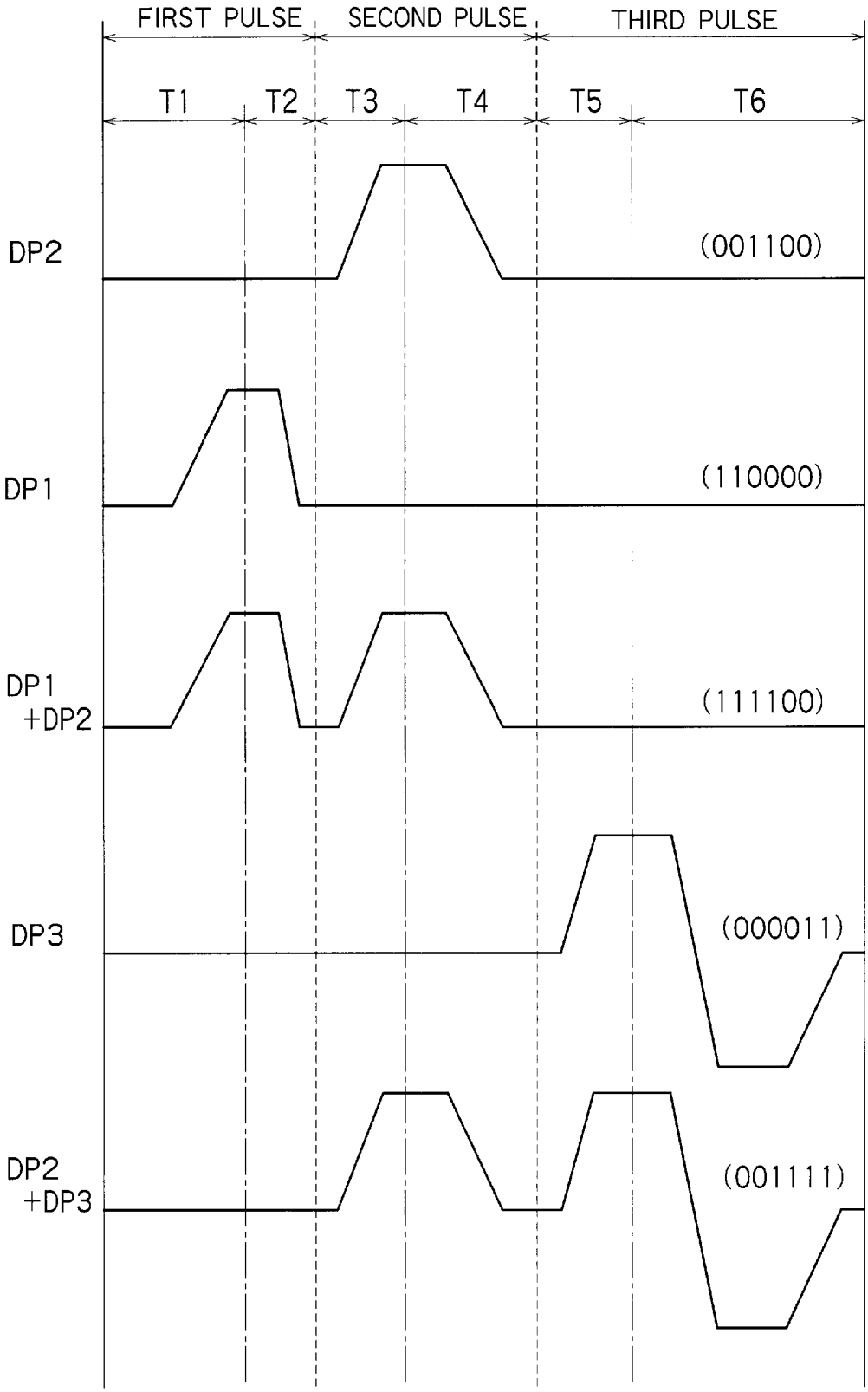
FIGS. 9 and 10 are views showing examples of driving signals generated from the common driving signal shown in FIG. 8A.
Figure 10:
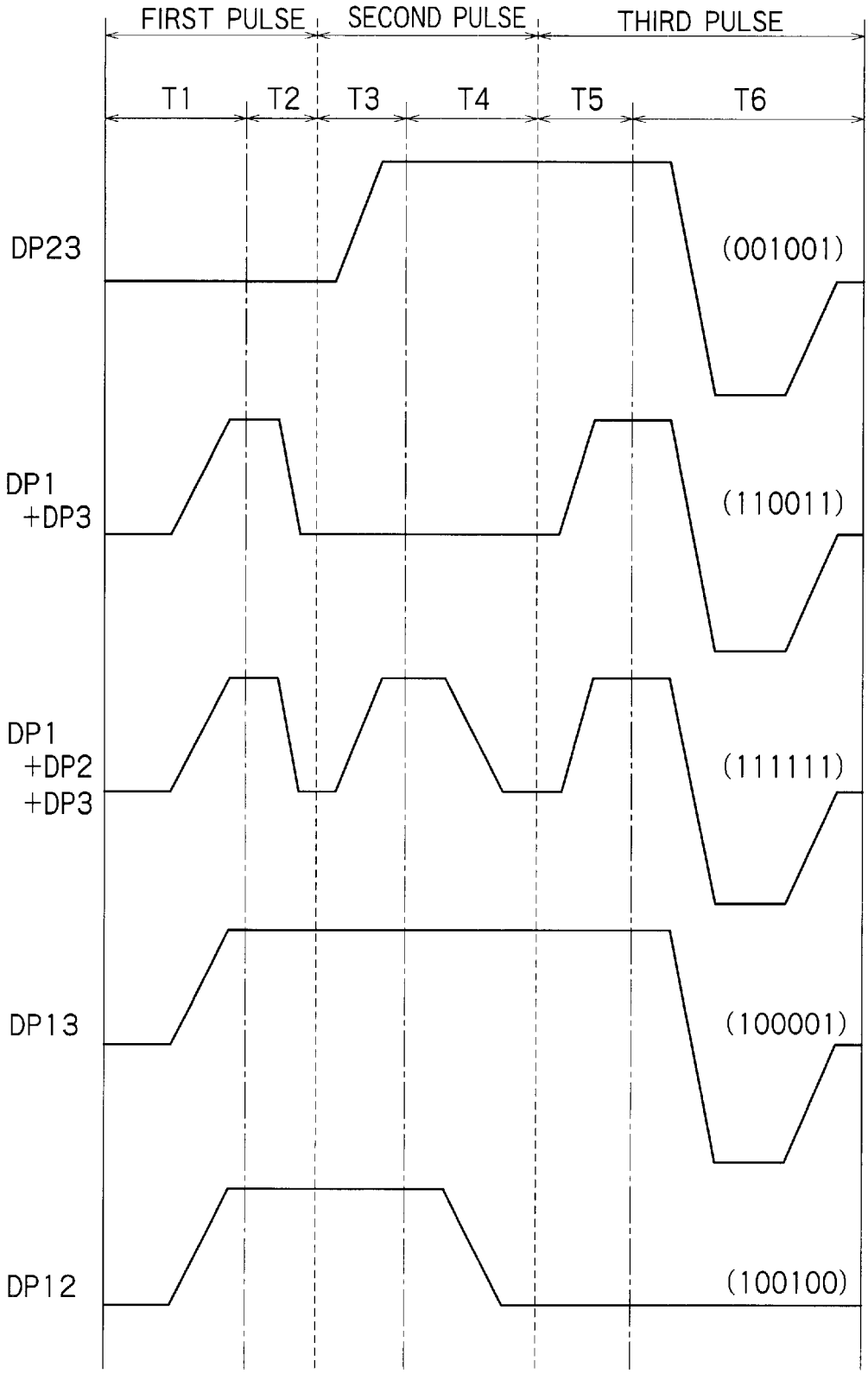

Furthermore, a driving signal C as shown in FIG. 8A is used as a common driving signal, and ten pulse selecting signals, which correspond to ten-gradated dots as shown in FIG. 8B respectively, are used in order to independently control volumes and the numbers of ink drops jetted from the first nozzle 1*a* and the second nozzle 2*a*, respectively, as shown in FIGS. 9 and 10. Thus, the ink jetting from each of the nozzles can have ten gradations.

Details of the ink jetting control using the driving signal C as shown in FIG. 8A is described in EP 0827838 A2, but some supplementary explanation is given as follows.

An example of ink jetting manner will be described with reference to FIGS. 8 through 10.

In the example, pulse elements of a driving signal are combined into new driving pulses. FIGS. 8A and 8B show the relationship of the driving signal and gray tone (gradation) values.

A first pulse is used for ejecting (jetting) an ink drop of approximately 5 ng. A second pulse is for ejecting an ink drop of approximately 2 ng. A third pulse is for ejecting an ink drop of about 10 ng. The ink drop ejected by the first pulse is deposited on a printing material to form a dot of a small diameter (small dot) thereon. The ink drop ejected by the second pulse is deposited on the printing material to form a dot of an extremely small diameter (extremely small dot) thereon. The ink drop by the third pulse is deposited on the printing material to form a dot of a medium diameter (medium dot) thereon.

The first pulse rises in voltage value from a medium potential Vm (P11) to a maximum potential VP at a preset inclination θC1 (P12), maintains the maximum potential VP for a preset time (P13). The first pulse descends in potential value from the maximum potential VP to the medium potential Vm at a preset inclination θD1 (P14), and maintains the medium potential Vm (P15). The discharging inclination θD1 is larger than the charging inclination θC1.

The second pulse, similarly to the first pulse, starts to ascend in voltage variation profile from the medium potential Vm to the maximum potential VP at a preset inclination θC2 (P21). After the second pulse maintains the maximum potential VP for a preset time (P22), it descends to the medium potential Vm at a preset inclination θD2 (P23), and keeps the medium potential Vm (P24). In the case of the second pulse, the charging inclination θC2 is larger than the discharging inclination θD2.

The third pulse starts to ascend in voltage variation profile from the medium potential Vm to the maximum potential VP at a preset inclination θC3 (P31), and the maximum potential VP is continued for a preset time (P32). Then, the third pulse descends from the maximum potential VP to the minimum potential VL at a preset inclination θD3 (P33).

In this profile, the discharging inclination θD3 is larger than the charging inclination θC3. A time taken for the third pulse to drop from the maximum potential VP to the minimum potential VL is set to be substantially equal to a period TA of a natural frequency of the piezoelectric vibrating element 113. The minimum potential VL is preferably set at a ground level (0V) or a positive potential in order to prevent the polarization of the piezoelectric vibrating element 113 from being reversed.

In the voltage profile of the third pulse, the minimum potential VL continues for a preset time (P34), and then its voltage value rises to the medium potential Vm again (P35). A time ranging from the start of the voltage decreasing till the end of the continuation of the minimum potential VL is set to be substantially equal to a period TC (Helmholtz period) of a natural frequency of ink.

Each of the first to third pulses is divided, in the pulse width direction, into two portions according to printing data. In other words, it may be considered that each drive pulse comprises a couple of right and left waveform elements. More specifically, the first pulse is divided, in its waveform segment P13, into a couple of waveform elements of time periods T1 and T2. The second pulse is divided, in its waveform segment P22, into a couple of waveform elements of time periods T3 and T4. The third pulse is divided, in its waveform segment P32, into a couple of waveform elements of time periods T5 and T6.

If those waveform elements are selectively combined, it is possible to generate some new driving pulses, which are not found in the original driving signal. Thus, the present embodiment can secure a larger number of pulse patterns and thus a larger number of gray scales than the cases of FIGS. 6 and 7. The first to third driving pulses that can be clearly found in the original driving signal may be referred to as "original driving pulses". On the other hand, newly generated driving pulses may be referred to as "composite driving pulses".

In FIGS. 9 and 10, selectable driving pulse patterns are illustrated in the ascending order of the weights of jetted ink drops from top to bottom.

In left sides of FIGS. 9 and 10, the pulse patterns of the driving signal are labeled with DP. For example, DP1 indicates a pulse pattern of the driving signal, which includes only the first pulse. In FIG. 10, DP23 indicates a new driving pulse formed by coupling the DP2 and the DP3. DP13 indicates a new driving pulse formed by coupling the DP1 and the DP3. DP12 indicates a new driving pulse formed by coupling the DP1 and the DP2.

It is assumed that the weights of ink drops ejected by those driving signals are: DP1=5 ng, DP2=2 ng, DP3=10 ng, DP13=20 ng, and DP23=14 ng. Then, the weights of the ink drops caused by those driving signals or pulse patterns, are:

DP2<DP1<DP1+DP2<DP3<DP2+DP3<DP23<DP1+DP3<DP1+DP2+DP3<DP13.

The driving pulse DP12 formed by coupling the first and second pulses and illustrated as the lowermost driving signal in FIG. 10 is provided as a minutely vibrating pulse, i.e., a nonprint pulse not ejecting ink drop.

How to compose new driving pulses from the first to third pulses being original driving pulses and how to express image and text in multilevel on the gray scale by selecting one or more composite pulses and original pulses will be described.

In the present example, a maximum of 10 pulse patterns can be obtained. Therefore, the gray tone can be expressed in a maximum of 10 levels. In the case of 10 gray-tone levels, each gray-tone value can be expressed in a compressed form consisting of 4-bit data, as shown at a left column in FIG. 8B. Thus, in order to obtain a desired gray tone by driving the piezoelectric vibrating element 113, it is necessary to decode the 4-bit data into 6-bit data corresponding to respective time periods T1 to T6 within the print period, as shown at a right column in FIG. 8B.

A gray-tone value for selecting the second pulse is compressedly expressed by "0001". To actually apply only the second pulse to the piezoelectric vibrating element 113, it is necessary to set the print data at "1" for the time periods T3 and T4 of the second pulse in order to operate the switch circuit. Thus, the 4-bit data of the gray tone value "0001" is converted into the 6-bit data "001100", whereby only the second pulse is applied to the piezoelectric vibrating element 113. Similarly, in order to select only the first pulse, it is necessary to set the print data at "1" for the time periods T1 and T2. To select only the third pulse, it is necessary to set the print data at "1" for the time periods T5 and T6.

How to generate new driving pulses is explained as follows. A case of composing a new driving signal having the pulse pattern DP23 from the second and third pulses will be described by way of example, as shown at an uppermost part in FIG. 10. If the print data is set to "1" at the start of the time period T3, the voltage is applied to the piezoelectric vibrating element 113 in accordance with a profile of the waveform element during the time period T3. Then, the print data is set to "0" at the start of the time period T4, and a state of "0" is continued till the subsequent time period T5 is terminated.

In the state that the print data is set at "0", a voltage variation of the driving signal is not transferred to the piezoelectric vibrating element 113. In this state, the piezoelectric vibrating element 113 holds the charges, and the voltage across the piezoelectric vibrating element 113 is kept at its just-before voltage VP. Strictly, the piezoelectric vibrating element 113 is slightly discharged i.e. looses some charges during the "0" state of the print data. However, no problem arises practically since the discharging operation continues only for a very short time.

If the print data is set to "1" at the start of the time period T6, the driving signal is again applied to the piezoelectric vibrating element 113, and the piezoelectric vibrating element 113 is swiftly discharged to expand. Thus, a new composite pulse formed by coupling a part of the second pulse and a part of the third pulse can be applied to the piezoelectric vibrating element 113, as shown in the uppermost part in FIG. 10.

Thus, the waveform elements can be coupled with each other in such a manner that the print data is set to "1" during the appearance of each of those waveform elements and that it is set to "0" during time interval between those waveform elements. Data of one bit assigned to each of the waveform elements corresponds to a "pulse selecting signal". The potential values of the waveform elements at the junction point between them are preferably equal to each other.

Alternatively, a driving signal used for the ink jetting from the first nozzles 1*a* may be adopted to be completely different from a driving signal used for the ink jetting from the second nozzles 2*a* . For example, if a volume of the ink drop jetted from the first nozzle 1*a* may be selected from 13 pl, 26 pl and 39 pl and a volume of the ink drop jetted from the second nozzle 2*a* may be selected from 2 pl, 5 pl and 11 pl, a larger number of gradations (gray tones) can be achieved.

Furthermore, it is preferable that each driving signal used for the ink jetting from the nozzles may be selected for each ink jetting.

The above driving methods are used for any ink jetting unit that can suitably control behavior of the meniscus to jet an ink drop having a desired volume. For example, they are applied to an electrical-mechanical converting element as an ink jetting unit, such as a piezoelectric vibrating member.

When a heating device such as a heater is used as an ink jetting unit (bubble-jet type), an ink drop having a desired volume can be jetted by adjusting energy applied to the heater. Alternatively, when a plurality of heaters are provided for each nozzle, a size of the ink drop can be adjusted by controlling respective energy applied to the plurality of heaters according to an ON-OFF control or a pulse-width modulation control. Alternatively, by forming the head and/or the nozzles themselves to be suitable for jetting different sizes of ink drops, a size of the ink drop can be adjusted. Of course, the above controlling manners may be combined suitably.

In addition, the first nozzles 1*a* and the second nozzles 2*a* may be formed in different recording heads, respectively. In the case, although a scanning operation of each recording head can be controlled independently, an ink jetting from a first nozzle 1*a* and an ink jetting from a second nozzle 2*a* paired with the first nozzle 1*a* can be carried out in the same main scan for the same picture element while having a slight gap.

Figure 11:
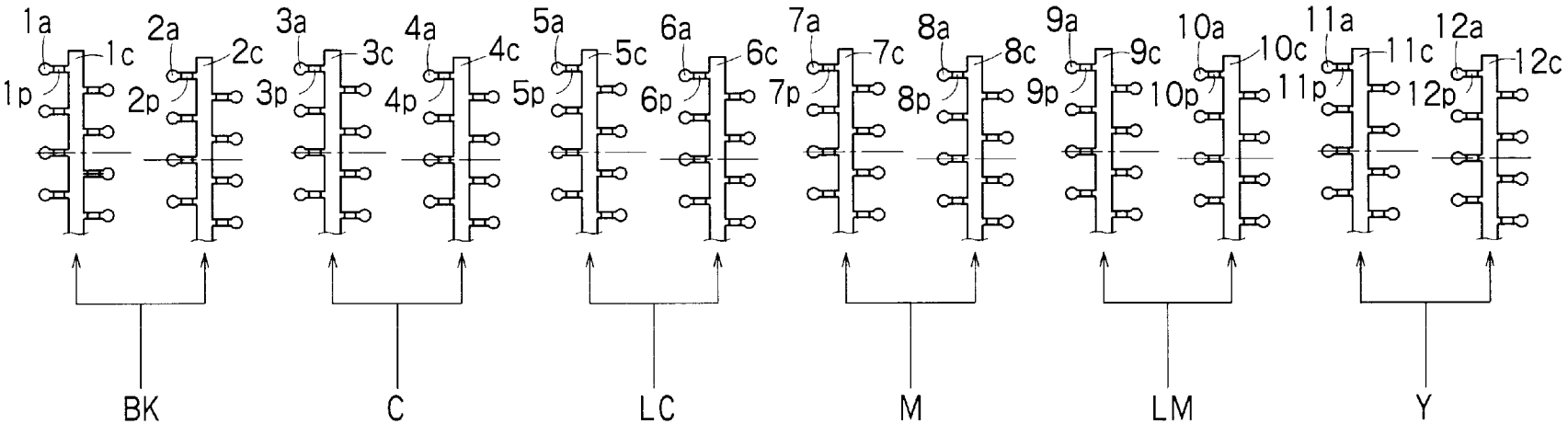
FIG. 11 is a schematic view of a recording head of a second embodiment of an ink-jet recording apparatus according to the invention.

Next, an ink-jet recording apparatus of a second embodiment according to the invention is explained with reference to FIG. 11. FIG. 11 is a schematic view of a recording head of the second embodiment.

As shown in FIG. 11, the recording head 10 of the embodiment has a third ink supplying way 3*c* and a fourth ink supplying way 4*c*, which are adjacent to the first ink supplying way 1*c* and the second ink supplying way 2*c*, which are adapted to supply the same kind of ink and which are substantially parallel with each other. In addition, a plurality of third nozzles 3*a* are communicated with the third ink supplying way 3*c*, and a plurality of fourth nozzles 4*a* are communicated with the fourth ink supplying way 4*c*.

Similarly, the recording head 10 of the embodiment has a fifth ink supplying way 5*c* and a sixth ink supplying way 6*c*, which are adjacent to the third ink supplying way 3*c* and the fourth ink supplying way 4*c*, which are adapted to supply the same kind of ink and which are substantially parallel with each other. In addition, a plurality of fifth nozzles 5*a* are communicated with the fifth ink supplying way 5*c*, and a plurality of sixth nozzles 6*a* are communicated with the sixth ink supplying way 6*c*.

Similarly, the recording head 10 of the embodiment has a seventh ink supplying way 7*c* and a eighth ink supplying way 8*c*, which are adjacent to the fifth ink supplying way 5*c* and the sixth ink supplying way 6*c*, which are adapted to supply the same kind of ink and which are substantially parallel with each other. In addition, a plurality of seventh nozzles 7*a* are communicated with the seventh ink supplying way 7*c*, and a plurality of eighth nozzles 8*a* are communicated with the eighth ink supplying way 8*c*.

Similarly, the recording head 10 of the embodiment has a ninth ink supplying way 9*c* and a tenth ink supplying way 10*c*, which are adjacent to the seventh ink supplying way 7*c* and the eighth ink supplying way 8*c*, which are adapted to supply the same kind of ink and which are substantially parallel with each other. In addition, a plurality of ninth nozzles 9*a* are communicated with the ninth ink supplying way 9*c*, and a plurality of tenth nozzles 10*a* are communicated with the tenth ink supplying way 10*c*.

Similarly, the recording head 10 of the embodiment has a eleventh ink supplying way 11*c* and a twelfth ink supplying way 12*c*, which are adjacent to the ninth ink supplying way 9*c* and the tenth ink supplying way 10*c*, which are adapted to supply the same kind of ink and which are substantially parallel with each other. In addition, a plurality of eleventh nozzles 11*a* are communicated with the eleventh ink supplying way 11*c*, and a plurality of twelfth nozzles 12*a* are communicated with the twelfth ink supplying way 12*c*.

Into the first ink supplying way 1*c* and the second ink supplying way 2*c*, the same BK (black) ink is adapted to be supplied from the same BK (black) ink cartridge in common.

Into the third ink supplying way 3*c* and the fourth ink supplying way 4*c*, the same C (cyan) ink is adapted to be supplied from the same C (cyan) ink cartridge in common.

Into the fifth ink supplying way 5*c* and the sixth ink supplying way 6*c*, the same LC (light cyan) ink is adapted to be supplied from the same LC (light cyan) ink cartridge in common.

Into the seventh ink supplying way 7*c* and the eighth ink supplying way 8*c*, the same M (magenta) ink is adapted to be supplied from the same M (magenta) ink cartridge in common.

Into the ninth ink supplying way 9*c* and the tenth ink supplying way 10*c*, the same LM (light magenta) ink is adapted to be supplied from the same LM (light magenta) ink cartridge in common.

Into the eleventh ink supplying way 11*c* and the twelfth ink supplying way 12*c*, the same Y (yellow) ink is adapted to be supplied from the same Y (yellow) ink cartridge in common.

An ink jetting unit 3*p*–12*p* (a second ink jetting unit) is provided at each of the third nozzles 3*a* to the twelfth nozzles 12*a* for causing each of the nozzles to jet the ink. In the case, each ink jetting unit 3*p*–12*p* is formed by a piezoelectric vibrating member provided at a pressure generating chamber communicated with each of the nozzles 3*a*–12*a*.

In addition, numbers of the third, fifth, seventh, ninth or eleventh nozzles 3*a*, 5*a*, 7*a*, 9*a* and 11*a* and numbers of the fourth, sixth, eighth, tenth or twelfth nozzles 4*a*, 6*a*, 8*a*, 10*a* and 12*a* are respectively identical so that each of the third, fifth, seventh, ninth or eleventh nozzles 3*a*, 5*a*, 7*a*, 9*a* or 11*a* and each of the fourth, sixth, eighth, tenth or twelfth nozzles 4*a*, 6*a*, 8*a*, 10*a* or 12*a* are paired with each other. Each of the fourth, sixth, eighth, tenth or twelfth nozzles 4*a*, 6*a*, 8*a*, 10*a* or 12*a* is formed at a position shifted by a slight distance d in the sub scanning direction from each of the third, fifth, seventh, ninth or eleventh nozzles 3*a*, 5*a*, 7*a*, 9*a* or 11*a* paired therewith. That is, there is a slight gap d between a moving track of the third, fifth, seventh, ninth or eleventh nozzle 3*a*, 5*a*, 7*a*, 9*a* or 11*a* by the main scan controlling unit 15 and a moving track of the fourth, sixth, eighth, tenth or twelfth nozzle 4*a*, 6*a*, 8*a*, 10*a* or 12*a* respectively paired with the third, fifth, seventh, ninth or eleventh nozzle 3*a*, 5*a*, 7*a*, 9*a* or 11*a* by the main scan controlling unit 15.

The jet-distribution controlling unit 30 is connected to the ink jetting units 3*p*–12*p* as well. The jet-distribution controlling unit 30 is adapted to control the ink jetting units 3*p*–12*p* and the main scan controlling unit 15 in such a manner that both an ink jetting from a third, fifth, seventh, ninth or eleventh nozzle 3*a*, 5*a*, 7*a*, 9*a* or 11*a* and an ink jetting from a four, sixth, eighth, tenth or twelfth nozzle 4*a*, 6*a*, 8*a*, 10*a* or 12*a* respectively paired with the third, fifth, seventh, ninth or eleventh nozzle 3*a*, 5*a*, 7*a*, 9*a* or 11*a* are carried out in the same main scan to positions that are slightly shifted from each other in the same picture element.

Other structure is substantially the same as the ink-jet recording apparatus of the first embodiment shown in FIGS. 1 and 2. In the second embodiment, the same numeral references correspond to the same elements as the first embodiment shown in FIGS. 1 and 2. The explanation of the same elements is not repeated.

According to the second embodiment, regarding each of the six color-inks, the ink jetting from the two nozzles can be carried out for the same picture element in the one main scan. Thus, color printing with high quality can be achieved. In addition, since the main scan is not repeated, color printing at a high speed can be achieved.

In the second embodiment, since the two lines of nozzles from which the same ink is jetted for the same picture element in the one main scan are adjacent, dots of big size can be easily formed because of ink permeation. However, arrangement of nozzle lines can be freely selected depending on characteristics of the ink and characteristics of the recording medium. For example, the following arrangement of a third embodiment can be adopted.

Figure 12:
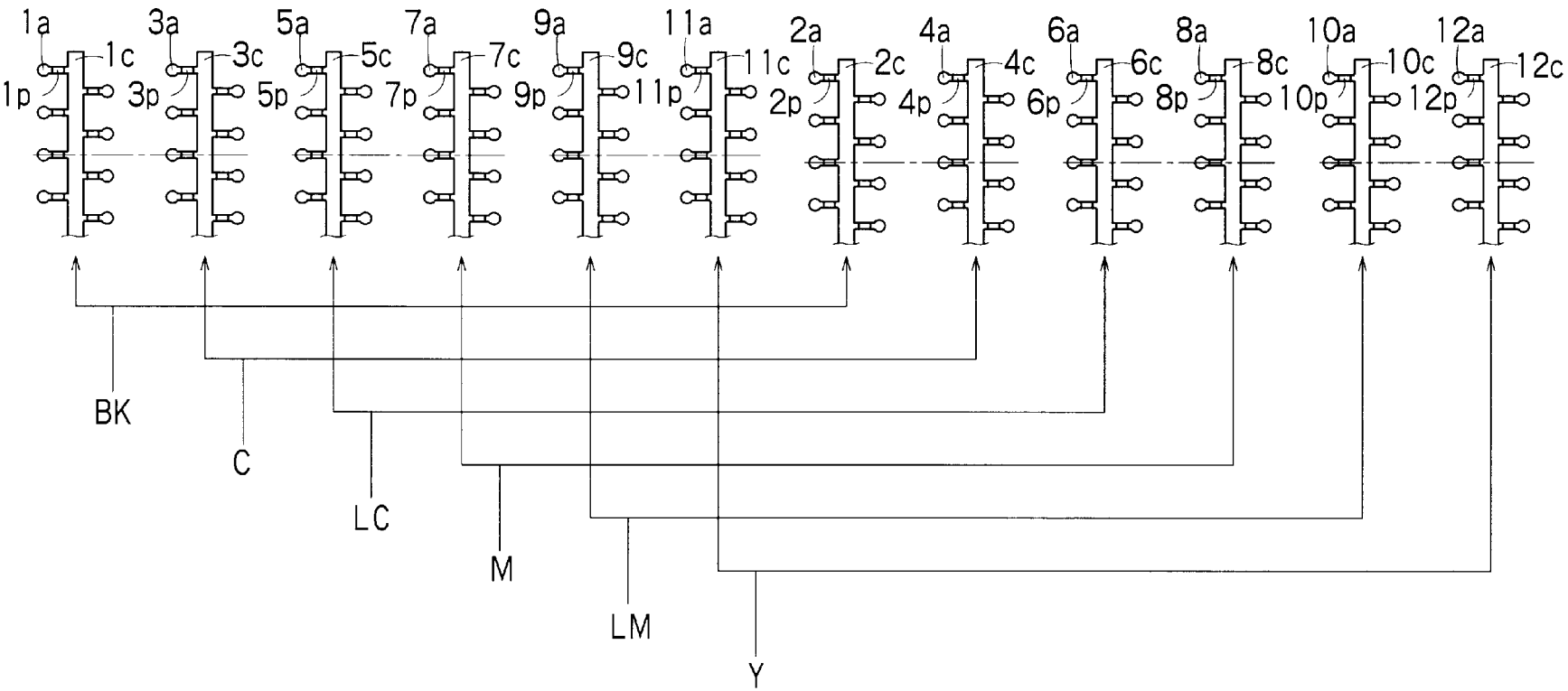
FIG. 12 is a schematic view of a recording head of a third embodiment of an ink-jet recording apparatus according to the invention.

Next, an ink-jet recording apparatus of a third embodiment according to the invention is explained with reference to FIG. 12. FIG. 12 is a schematic view of a recording head of the third embodiment.

As shown in FIG. 12, the recording head 22 of the embodiment has a third ink supplying way 3*c*, a fifth ink supplying way 5*c*, a seventh ink supplying way 7*c*, a ninth ink supplying way 9*c* and a eleventh ink supplying way 11*c* between the first ink supplying way 1*c* and the second ink supplying way 2*c*. In addition, there are a fourth ink supplying way 4*c*, a sixth ink supplying way 6*c*, a eighth ink supplying way 8*c*, a tenth ink supplying way 10*c* and a twelfth ink supplying way 12*c*, in order adjacent to the second ink supplying way 2*c*.

Other structure is substantially the same as the ink-jet recording apparatus of the second embodiment shown in FIG. 11. In the third embodiment, the same numeral references correspond to the same elements as the second embodiment shown in FIG. 11. The explanation of the same elements is not repeated.

In the third embodiment, since the two lines of nozzles from which the same ink is jetted for the same picture element in the one main scan are arranged away from each other, a following ink drop can be jetted after a previously jetted ink drop has been dried. The arrangement may achieve better image quality depending on characteristics of the ink and characteristics of the recording medium.

Figure 13:
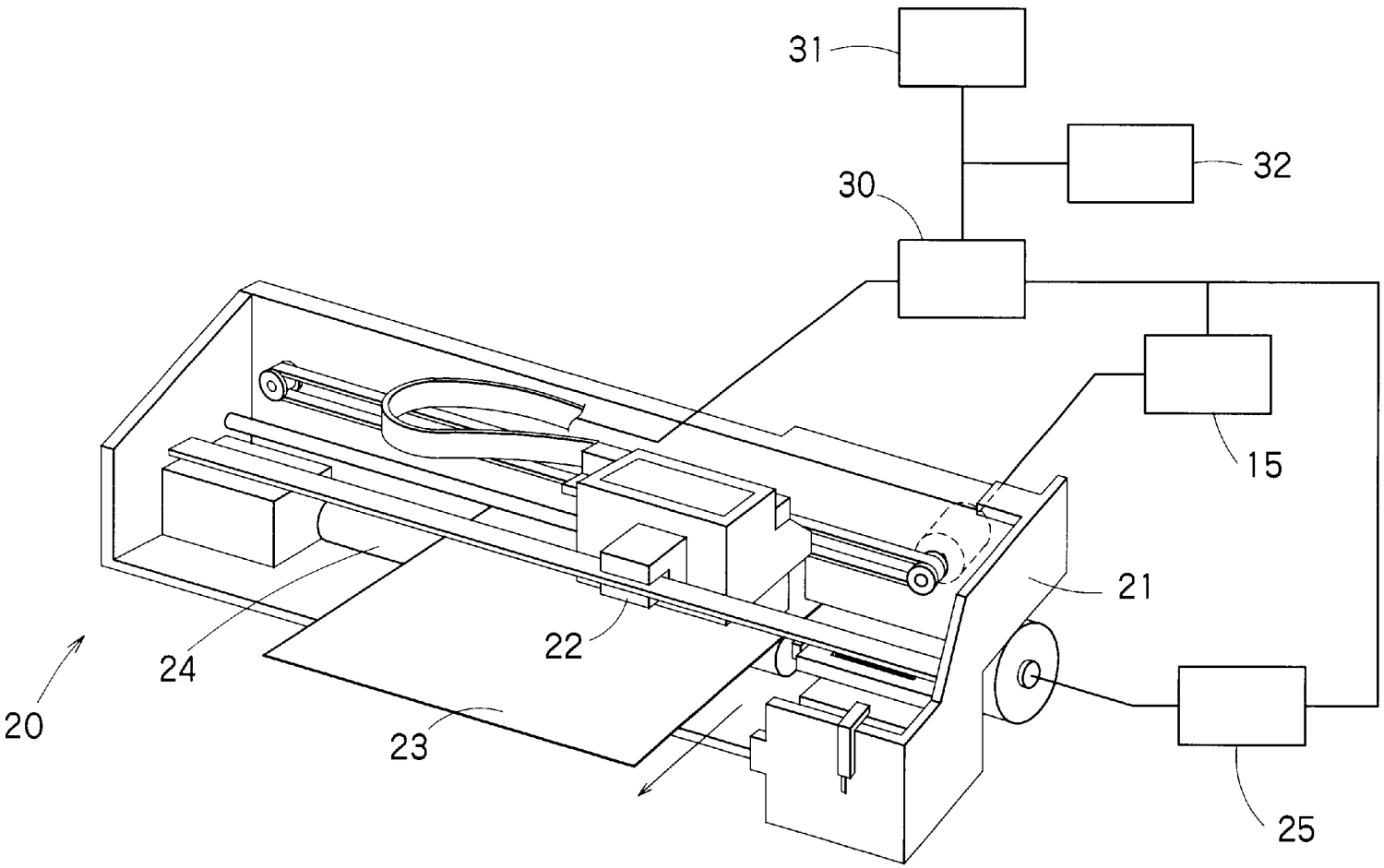
FIG. 13 is a schematic view of a recording head of a fourth embodiment of an ink-jet recording apparatus according to the invention.

Next, an ink-jet recording apparatus of a fourth embodiment according to the invention is explained with reference to FIG. 13. FIG. 13 is a schematic view of a recording head of the fourth embodiment.

As shown in FIG. 13, in the ink-jet recording apparatus of the embodiment, the jet-distribution controlling unit 30 is also connected to the sub scan controlling unit 25, and is adapted to control the ink jetting units 1*p* and 2*p*, the main scan controlling unit 15 and the sub scan controlling unit 25, based on a recording mode defined by a sub scan feed amount and information about used nozzles in a main scan.

In addition, the ink-jet recording apparatus of the embodiment has a recording mode storing unit 31 that stores a plurality of recording modes, and a selecting unit 32 that selects a suitable recording mode among the plurality of recording modes stored in the recording mode storing unit 31.

Herein, the information about used nozzles in the main scan means nozzle pitch k, the number of used nozzles N, the number of scan repeat s and effective number of nozzles Neff.

Other structure is substantially the same as the ink-jet recording apparatus of the first embodiment shown in FIGS. 1 and 2. In the fourth embodiment, the same numeral references correspond to the same elements as the first embodiment shown in FIGS. 1 and 2. The explanation of the same elements is not repeated.

According to the embodiment, a control based on a suitable recording mode can be achieved for each pair of nozzles being a combination of a first nozzle 1*a* and a second nozzle 2*a*.

The recording mode defined by the sub scan feed amount and the information about used nozzles in the main scan is explained by Japanese Patent Laid-Open Publication No. 10-337864 in detail. Although all contents of the Publication No. 10-337864 are set herein as a content of the specification, supplementary explanation is given as follows. Each nozzle in the following explanation corresponds to each pair (two) of nozzles of the above embodiment.

Figure 14:
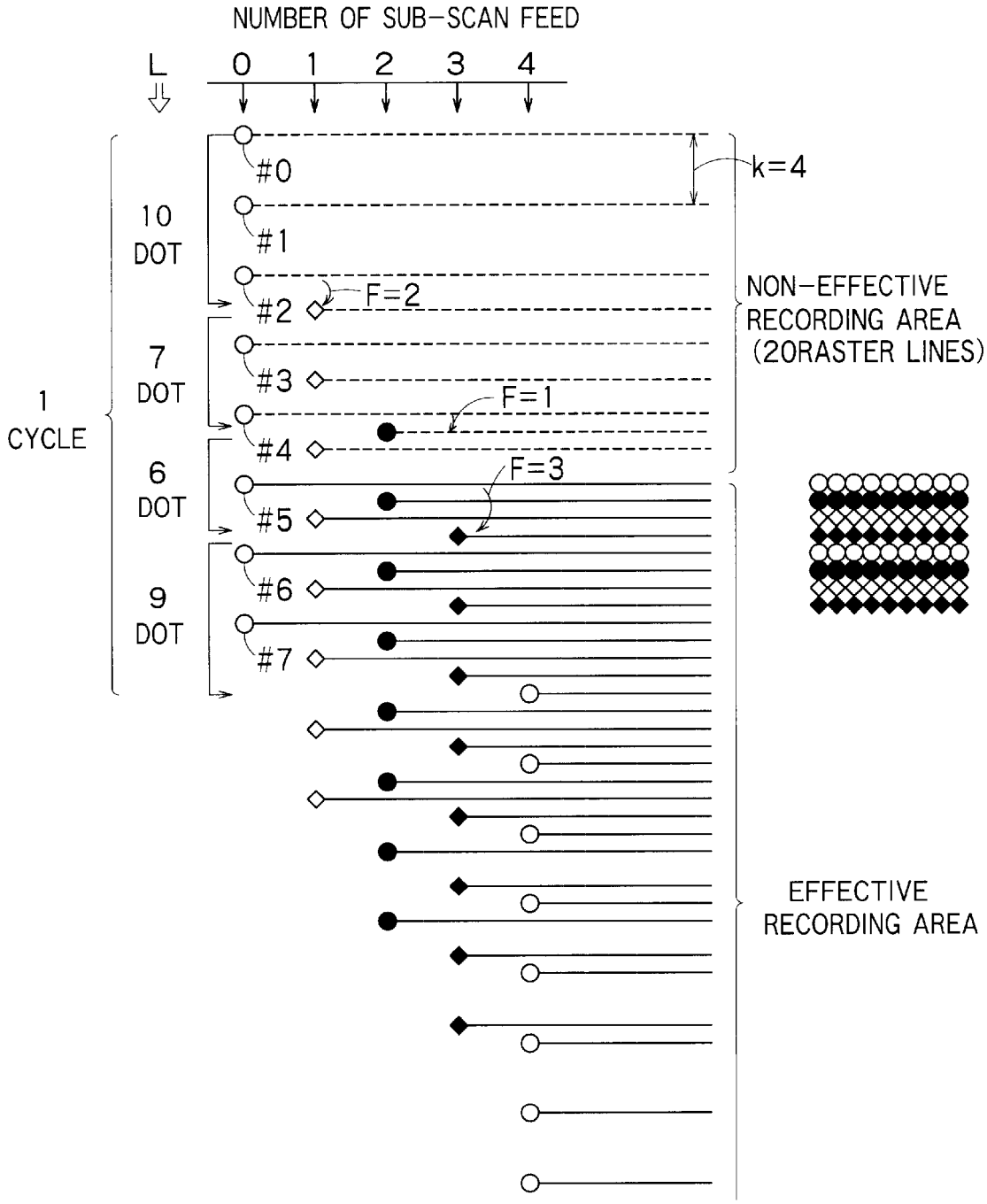
FIG. 14 is an explanatory view showing a first recording mode for k=4.

FIG. 14 shows a first dot recording scheme (a first recording mode) with dot pitch k equal to 4 dots. Scan parameters (information about used nozzles) of this dot recording scheme are shown at the bottom of FIG. 9, where the nozzle pitch k is equal to 4 dots, the number of used nozzles N is equal to 8, the number of scan repeats s is equal to 1, and the number of effective nozzles Neff is equal to 8.

In the example of FIG. 14, nozzle numbers #0 through #7 are allocated to the eight used nozzles in turn from the top. In the first dot recording scheme for k=4, four sub-scan feeds constitute one cycle, and the amount of the sub-scan feed L is varied in the sequence of 10, 7, 6, and 9 dots. This means that a plurality of different values are used for the sub-scan feed amount L. The positions of the eight nozzles in the respective sub-scan feeds are shown by four different figures. In the first dot recording scheme for k=4, a non-effective record area of 20 raster lines is present before an effective record area. That is, the effective record area starts at the 21st raster line from an upper end of a nozzle scan area (a range including the effective record area and the non-effective record area). Herein, the nozzle position in the first main scan is set to be apart from an upper end of a printing paper by a predetermined distance. Thus, an earlier starting position of the effective record area enables dots to be recorded from a position closer to the upper end of the printing paper.

FIGS. 15A and 15B show scan parameters and raster numbers of effective raster lines recorded by the respective nozzles, in a first dot recording scheme for k=4. A table of FIG. 15A shows a sub-scan feed amount L and a summation SIGMA L thereof for each sub-scan feed, and nozzle offset F after each sub-scan feed.

The first dot recording scheme for k=4 has following two features. The first feature is that the nozzle pitch k and the number of used nozzles N are integers which are no less than 2 and which are not relatively prime. The second feature is that a plurality of different values are used for the sub-scan feed amount L. Application of the dot recording scheme having the first feature advantageously increases the number of used nozzles as many as possible. The second feature can allow a fundamental requirement that there is no dropout or overlap of recorded raster lines in the effective record area to be satisfied even when the dot recording scheme has the first feature. If the dot recording scheme has the first feature but a fixed sub-scan feed amount L is applied, there will be dropout or overlap of raster lines.

FIG. 15B shows the raster numbers of the effective raster lines recorded by the respective nozzles in a main scan after each sub-scan feed. A left-hand side of FIG. 15B shows the nozzle numbers #0 through #7. Values on a right-hand side of the nozzle numbers represent which raster lines in the effective record area are recorded by the respective nozzles after the 0th to 7th sub-scan feeds. By way of example, in the main scan after the 0th sub-scan feed (that is, in the first main scan for recording the effective record area), the nozzles #5 through #7 record the 1st, 5th, and 9th effective raster lines. In the main scan after the 1st sub-scan feed, the nozzles #3 through #7 record the 3rd, 7th, 11th, 15th, and 19th effective raster lines. The term "effective raster lines" here denotes the raster lines in the effective record area.

It can be understood that, in FIG. 15B, a difference between raster numbers of the effective raster lines recorded during one main scan is equal to the nozzle pitch k(=4). One scan cycle accordingly records N×k (that is, 32) raster lines. Since any adjacent nozzles are apart from each other by the nozzle pitch k, as clearly understood from FIG. 9, one cycle does not record 32 sequential raster lines. FIG. 15B shows which nozzles are used to record the first 32 raster lines in the effective record area.

In FIG. 15B, the effective raster numbers written in brackets show that the raster lines at the positions having the equivalent scanning conditions have been recorded in the previous cycle. Namely, the difference obtained by subtracting 32 from the numeral in the brackets indicates the equivalent raster line number. For example, the raster line of the effective raster number 36 recorded by the nozzle #0 is present at a position having scanning conditions equivalent to those of the raster line of the effective raster number 4.

FIG. 16 shows the nozzle numbers for recording the effective raster lines in the first dot recording scheme for k=4. Numerals 1 through 31 on a left-end column of FIG. 16 show the effective raster numbers. A right-hand side of FIG.

16 shows positions of the effective raster lines recorded by the eight nozzles #0 through #7 in the main scans after the respective sub-scan feeds. For example, in the main scan after the 0th sub-scan feed, the nozzles #5 through #7 record the 1st, 5th, and 9th effective raster lines, respectively. Comparison between FIG. 16 and FIG. 15B clearly shows a relationship between the effective raster lines and the nozzle numbers.

Four different symbols "•", "X", "↑", and "↓" in the second-left column of FIG. 16 show whether or not the adjoining raster lines have already been recorded before the recording of each raster line. The respective symbols have the following meaning:

↓: Only one raster line immediately below itself has already been recorded.

↑: Only one raster line immediately above itself has already been recorded.

X: Both raster lines above and below itself have already been recorded.

•: Neither of the raster lines above and below itself have been recorded.

Recording state of the adjoining raster lines above and below each raster line affects an image quality of the raster line being recorded. Effects on the image quality are ascribed to dryness of ink on the adjoining raster lines that have already been recorded and/or to sub-scan feed errors. If a pattern by the four different symbols appears at a relatively large interval, it may deteriorate the image quality of the whole image.

In the first dot recording scheme shown in FIG. 16, however, the pattern by the four different symbols does not show any clear periodicity. It is accordingly expected that the first dot recording scheme causes less deterioration of the image quality due to the above reason but enables an image of relatively good image quality to be recorded.

The third-left column of FIG. 16 shows a value Δ representing how many sub-scan feeds have been executed at the maximum between recording of any adjoining raster line and recording of each raster line. The value Δ is hereinafter referred to as the "sub-scan feed number difference".

By way of example, the second effective raster line is recorded by the nozzle #1 after the 2nd sub-scan feed, whereas the first raster line is recorded by the nozzle #5 after the 0th sub-scan feed and the third raster line is recorded by the nozzle #3 after the 1st sub-scan feed. The sub-scan feed number difference Δ is accordingly equal to 2 with respect to the second raster line. In a similar manner, the fourth raster line is recorded after three sub-scan feeds have been executed since recording of the fifth raster line. The sub-scan feed number difference Δ is thus equal to 3 with respect to the fourth raster line.

Since one cycle consists of k(=4) sub-scan feeds, the sub-scan feed number difference Δ may be a value in a range of 0 to k. In the first dot recording scheme for k=4, it is understood that the maximum sub-scan feed number difference Δ is equal to 3, which is smaller than the possible upper limit value k(=4).

It is ideal that the sub-scan feed is carried out strictly by the amount equal to an integral multiple of the dot pitch. In the actual state, however, the sub-scan feed has some feeding error. The sub-scan feed error is accumulated at every time of sub-scan feed. Thus, when a large number of sub-scan feeds are interposed between recording of adjoining two raster lines, the accumulated sub-scan feed error may cause a positional misalignment of the adjoining two raster lines.

As described above, the sub-scan feed number difference Δ shown in FIG. 16 denotes the number of sub-scan feeds carried out between recording of the adjoining raster lines. The smaller sub-scan feed number difference Δ is preferable, in order to minimize the positional misalignment of the adjoining raster lines due to the accumulated sub-scan feed error. In the first dot recording scheme for k=4 shown in FIG. 16, the sub-scan feed number difference Δ is not greater than 3 and is smaller than the upper limit value 4. This allows a favorable image to be recorded, from this viewpoint.

FIGS. 17A and 17B show scan parameters (information about used nozzles) and raster numbers of effective raster lines recorded by the respective nozzles, in a second dot recording scheme (a second recording mode) for k=4 in an embodiment of the present invention. FIGS. 17A and 17B correspond to FIGS. 15A and 15B in the first dot recording scheme discussed above. The first and second dot recording schemes for k=4 have the same nozzle pitch k and enable images to be recorded at an identical resolution [dpi]. In addition, the same number of effective nozzles Neff allows images to be recorded at an identical recording speed. The difference between the first and second dot recording scheme for k=4 is only the order of the sub-scan feed amounts L. In the first dot recording scheme for k=4, the sub-scan feed amount L varies in the sequence of 10, 7, 6, and 9 dots. In the second dot recording scheme for k=4, on the other hand, the sub-scan feed amount L varies in the sequence of 7, 6, 9, and 10 dots.

Like the first dot recording scheme for k=4, the second dot recording scheme for k=4 has the first feature that the nozzle pitch k and the number of used nozzles N are integers which are no less than 2 and which are not relatively prime, and the second feature that a plurality of different values are used for the sub-scan feed amount L.

FIG. 18 shows the nozzle numbers for recording the effective raster lines in the second dot recording scheme for k=4. FIG. 18 corresponds to FIG. 16 in the first dot recording scheme for k=4. Like the first dot recording scheme for k=4 shown in FIG. 16, in the second dot recording scheme for k=4, the pattern of the symbols (@) representing the recording state of the adjoining raster lines above and below each raster line does not have any clear periodicity. It is accordingly expected that the second dot recording scheme also achieves an image of relatively good quality. In addition, since the sub-scan feed number difference Δ is not greater than 3, this scheme enables a favorable image to be recorded, from the viewpoint of minimizing the accumulated sub-scan feed error.

As described above, both the first and second dot recording schemes for k=4 have the first feature that the nozzle pitch k and the number of used nozzles N are integers which are not less than 2 and which are not relatively prime, and the second feature that a plurality of different values are used for the sub-scan feed amounts L. In the case, there may be a large number of equivalent dot recording schemes that are different only in the order of the sub-scan feed amounts L. When there are a plurality of equivalent dot recording schemes that have an identical resolution and an identical recording speed but a difference in sequence of the sub-scan feed amounts L, individual ink-jet recording apparatuses such as printers have different choices for the dot recording scheme attaining the highest image quality. This is because the quality of an image recorded by each ink-jet recording apparatus depends upon combination of a manufacturing error of the ink-jet recording apparatus (for example, an error of the nozzle pitch and/or the sub-scan feed error) with a scanning technique adopted in the dot recording scheme (mainly the sub-scan feed amount). When there are a large number of dot recording schemes having a difference only in sequence of the sub-scan feed amounts, such as the first and second dot recording schemes, it is preferable to select the dot recording scheme attaining the higher image quality for each individual ink-jet recording apparatus.

Although not being specifically illustrated, the effective record area in the second dot recording scheme for k=4 starts at the 20th raster line from the upper end of the nozzle scanning area (the range including the effective record area and the non-effective record area). In the first dot recording scheme for k=4 shown in FIG. 14, on the other hand, the effective record area starts at the 21st raster line from the upper end of the nozzle scan area. This means that the starting position of the effective record area in the second dot recording scheme for k=4 is closer by one raster line to the upper end of the printing paper, compared with the first dot recording scheme for k=4.

Such difference in starting position of the effective record area is ascribed to the difference in the sequence of the sub-scan feed amounts L between the first dot recording scheme and the second dot recording scheme for k=4. The identical combination of four values is used for the sub-scan feed amounts L in both the first and second dot recording schemes for k=4, but the sequence of the values is different. Whereas the sub-scan feed amount L varies in the sequence of 10, 7, 6, and 9 in the first dot recording scheme for k=4, the sub-scan feed amount L varies in the sequence of 7, 6, 9, and 10 in the second dot recording scheme for k=4. The starting position of the effective record area is closer to the upper end of the printing paper in the second dot recording scheme for k=4. This may be attributable to the fact that the first sub-scan feed amount L(=7) in the second dot recording scheme for k=4 is smaller than that of the first sub-scan feed amount L(=10) in the first dot recording scheme for k=4.

This can be also understood from the following example. Consider here dot recording schemes in which the nozzle pitch k is equal to 12 dots and one cycle includes twelve scans. Plural combinations including seven feeds of 17 dots and five feeds of 5 dots are available for the sub-scan feed amounts L in these dot recording schemes. Among all the alternative dot recording schemes, a dot recording scheme that initially carries out five sub-scan feeds of 5 dots and subsequently seven sub-scan feeds of 17 dots will have an effective record area which starts at the 117th raster line from the upper end of the nozzle scan area (the range including the non-effective record area and the effective record area). A dot recording scheme that initially carries out seven sub-scan feeds of 17 dots and subsequently five sub-scan feeds of 5 dots will have, on the other hand, an effective record area which starts at the 129th raster line from the upper end of the nozzle scan range. Compared with the dot recording scheme that repeats the sub-scan feeds of 17 dots first, the dot recording scheme that repeats the sub-scan feeds of 5 dots first enables recording of the effective dots to start from the position closer to the upper end of the printing paper by 12 raster lines.

As clearly understood from this example, in general, smaller amounts for initial several sub-scan feeds among a plurality of sub-scan feeds included in one cycle tend to start the recording from a position closer to the upper end of the printing paper. From this viewpoint, it is preferable to select a dot recording scheme which has smaller amounts L for a predetermined number of (for example, two or three) initial sub-scan feeds, among a plurality of selectable dot recording schemes. In other words, it is preferable to select a sequence having smaller amounts L for a predetermined number of initial sub-scan feeds, among a plurality of choices having an identical combination of plural different values but a different sequence of the values. As shown by the comparison between the first and second recording schemes for k=4, there is a better possibility that a smaller amount for the first sub-scan feed L enables the recording to start from a position closer to the upper end of the printing paper. It is thus especially preferable to select a dot recording scheme which has a smaller first sub-scan feed amount L.

The starting position of the effective record area by each dot recording scheme can be known in advance from the scan parameters. It is accordingly possible to select a dot recording scheme which has an earliest (closest to the upper end of the printing paper) starting position of the effective record area among a plurality of selectable dot recording schemes. In a similar manner, it is possible to select a dot recording scheme having a latest (closest to a lower end of the printing paper) end position of the effective record area among the plurality of selectable dot recording schemes.

FIGS. 19A and 19B show scan parameters (information about used nozzels) and raster numbers of effective raster lines recorded by the respective nozzles, in a third dot recording scheme (a third recording mode) for k=4 in an embodiment of the present invention. The third dot recording scheme for k=4 has the same nozzle pitch k as that in the first and second dot recording schemes, but a different number of used nozzles N. That is, the third dot recording scheme has parameters of k=4 and N=7, which are relatively prime. A sub-scan feed amount L is fixed to 7 dots.

FIG. 20 shows the nozzle numbers for recording the effective raster lines in the third dot recording scheme for k=4. Unlike the first and second dot recording schemes for k=4 (FIGS. 16 and 18), in the third dot recording scheme for k=4, the pattern of the symbols @ representing the recording state of the adjoining raster lines above and below each raster line has a rather clear periodicity. Especially, the raster lines whose sub-scan feed number difference Δ is equal to 3 appear in a rather periodical manner. From the viewpoint of the image quality, the first and second dot recording schemes for k=4 are thus favorable over the third dot recording scheme for k=4.

From the viewpoint of the recording speed, the first and second dot recording schemes for k=4 are favorable over the third dot recording scheme for k=4. This is because the first and second dot recording schemes for k=4 use eight nozzles and simultaneously record eight raster lines, whereas the third dot recording scheme for k=4 uses seven nozzles and simultaneously records seven raster lines.

As described above, although the first through third dot recording schemes for k=4 can record dots at an identical resolution, the first and second dot recording schemes for k=4 are favorable over the third dot recording scheme for k=4 from the viewpoints of the image quality and the recording speed.

However, as described previously, in some actual ink-jet recording apparatuses, it is possible that the third dot recording scheme for k=4 attains better image quality than the first and second dot recording schemes for k=4. When a plurality of dot recording schemes (recording modes) are available to execute the recording at an identical resolution and at a substantially equal recording speed, it is desirable to select an appropriate dot recording scheme for each individual ink-jet recording apparatus among the plurality of dot recording schemes. The dot recording schemes having "the substantially equal recording speed" means that their difference in the number of effective nozzles Neff is within about 10%.

FIGS. 21A to 21C show scan parameters (information about used nozzles) in fourth through sixth dot recording schemes (recording modes) for k=4. In the fourth through sixth dot recording schemes for k=4, the numbers of used nozzles N in the first through third dot recording schemes for k=4 are doubled respectively, and the number of scan repeats s is set equal to 2. The numbers of effective nozzles Neff in the fourth through sixth dot recording schemes for k=4 are thus identical with those in the first through third dot recording schemes for k=4. The same repetition patterns are adopted for the sub-scan feed amount L. Since the number of scan repeats s is set equal to 2, the cycle of the sub-scan feed amount L in the first through third dot recording schemes for k=4 is repeated twice in the fourth through sixth dot recording schemes for k=4.

The nozzle pitch k in the fourth through sixth dot recording schemes is identical with that in the first through third dot recording schemes discussed above, so that images can be recorded at an identical resolution. In the fourth through sixth dot recording schemes for k=4, however, dots on each raster line are recorded not by one identical nozzle but by a plurality of different nozzles. Even when characteristics of the nozzles (for example, pitch and/or jetting characteristics) have some variation, this arrangement effectively prevents characteristics of a specific nozzle (a pair of nozzles) from affecting the whole of each raster line, which can improve the image quality.

In addition, in the fourth and fifth dot recording schemes for k=4, the number of effective nozzles Neff is equal to 8, which is the same as that in the first and second dot recording schemes for k=4. These four dot recording schemes accordingly have an identical recording speed. In a similar manner, the third and sixth dot recording schemes for k=4 have an identical recording speed.

FIGS. 22A to 22D show scan parameters (information about used nozzles) in first through fourth dot recording schemes (recording modes) for k=6. In the scan parameters of the first dot recording scheme for k=6 shown in FIG. 22A, the nozzle pitch k is equal to 6 dots, the number of used nozzles N is equal to 48, the number of scan repeats s is equal to 2, and the number of effective nozzles Neff is equal to 24. Six different values (20, 27, 22, 28, 21, and 26) are used for the sub-scan feed amounts L [dots]. The scan parameters of the second dot recording scheme for k=6 shown in FIG. 22B are identical with those of the first dot recording scheme for k=6, except the sub-scan feed amounts L.

In the scan parameters of the third dot recording scheme for k=6 shown in FIG. 22C, the nozzle pitch k is equal to 6 dots, the number of used nozzles N is equal to 47, the number of scan repeats s is equal to 2, and the number of effective nozzles Neff is equal to 23.5. Two different values (21 and 26) are used for the sub-scan feed amounts L [dots]. The scan parameters of the fourth dot recording scheme for k=6 shown in FIG. 22D are identical with those of the third dot recording scheme for k=6, except the sub-scan feed amounts L.

The number of used nozzles N is equal to 48 in the first and second dot recording schemes for k=6, whereas the number of used nozzles N is equal to 47 in the third and fourth dot recording schemes for k=6. Namely there is a difference in the number of used nozzles N between these two pairs of recording schemes. The difference in the number of used nozzles N is, however, not greater than about 10%, so that there is no significant difference in the recording speed.

Although the nozzles (pairs of nozzles in the embodiment) used for each main scan are fixed in the recording modes discussed above, used nozzles (pairs of nozzles) may, however, be selected for each main scan.

Figure 23:
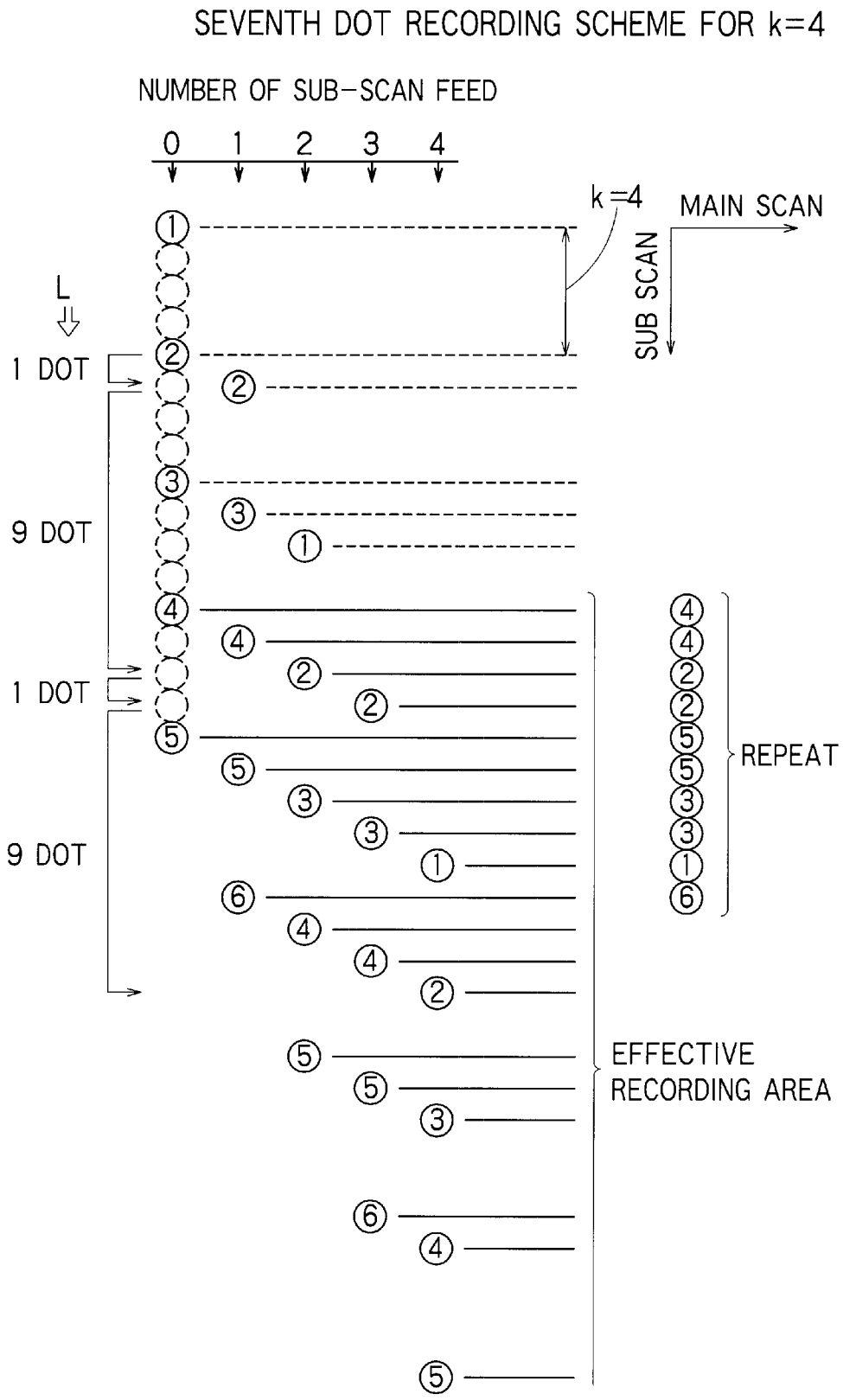
FIG. 23 is an explanatory view showing a seventh recording mode for k=4.

FIG. 23 shows a seventh dot recording scheme (seventh recording mode) for k=4, in which used nozzles are selected for each main scan. In this dot recording scheme, sub-scan feed amounts L of 1 dot and 9 dots are repeated. While the number of used nozzles N is fixed to 5, used nozzle numbers are changed in each main scan. That is, the first through fifth nozzles are used for main scans after even-numbered sub-scan feeds, whereas the second through sixth nozzles are used for main scans after odd-numbered sub-scan feeds. Nozzles that are not used for recording are omitted from the illustration.

Figure 24:
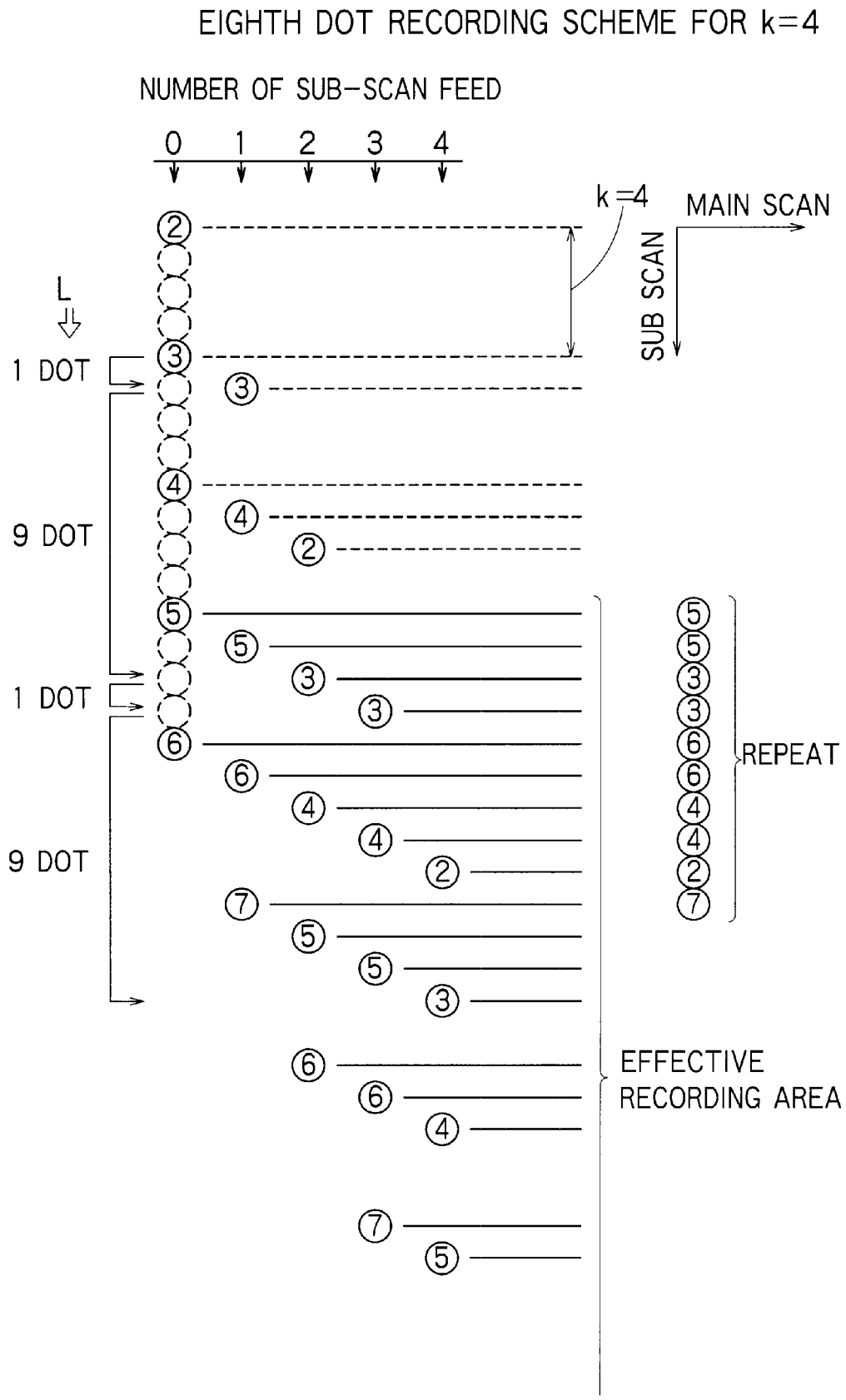
FIG. 24 is an explanatory view showing a eighth recording mode for k=4.

FIG. 24 shows an eighth dot recording scheme (eighth recording mode) for k=4, in which used nozzles are selected for each main scan. The sub-scan feeds in this dot recording scheme are identical with those discussed above with FIG. 23, but used nozzle numbers are different. That is, the second through sixth nozzles are used for main scans after even-numbered sub-scan feeds, whereas the third through seventh nozzles are used for main scans after odd-numbered sub-scan feeds.

Nozzle numbers of the nozzles used for recording the respective raster lines in the effective record area are shown on right-hand sides of FIGS. 23 and 24. Comparison between these nozzle numbers shows that sequence of the nozzle numbers used for recording the raster lines depends on selection of the used nozzles. The sequence of the nozzle numbers used for recording the raster lines significantly affects image quality as discussed below. That is, an actual pitch of nozzles in a nozzle array may be varied more or less because of manufacturing error of the nozzle array. The manufacturing error may cause a gap between the adjoining raster lines or a significant overlap of the adjoining raster lines, which may generate a banding (a poor image quality portion extending in the main scanning direction). Thus, even if the same print head is used, the banding easily occurs in some cases and it hardly occurs in other cases, depending on the sequence of the nozzle numbers used for recording the raster lines.

Thus, it is preferable to select a recording scheme that hardly causes the banding among a plurality of dot recording schemes which have different used nozzle numbers.

In addition, some dot recording schemes (recording modes) that regulate the number of used nozzles N in each scan may be suitable. In a suitable example, N1 nozzles are used in main scans after even-numbered sub-scan feeds and N2 nozzles (N1 and N2 are different integers) are used in main scans after odd-numbered sub-scan feeds. Regulation of the number of used nozzles in each main scan can increase a degree of freedom in setting the scan parameters, and thereby enhances the possibility of selecting a more appropriate dot recording scheme. When it is assumed that the number of scan repeats s is equal to 1 in the above case, an average of the number of effective nozzles Neff is (N1+N2)/2. It is thought that the recording speed is substantially proportional to this average of the number of effective nozzles Neff.

What is claimed is:

1. A liquid jetting apparatus comprising;

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, a sub scanning unit that causes the head member to move in a sub scanning direction perpendicular to the main scanning direction relatively to the recording medium, and a controlling unit connected to the liquid jetting unit and the main scanning unit, wherein:

there is a slight gap between a moving track of a first nozzle by the main scanning unit and a moving track of a second nozzle paired with the first nozzle by the main scanning unit, and the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

2. A liquid jetting apparatus according to claim 1, wherein:

the plurality of first nozzles are formed at substantially regular intervals, the plurality of second nozzles are formed at substantially regular intervals, the intervals between the first nozzles and the intervals between the second nozzles are identical, a number of the first nozzles and a number of the second nozzles are identical so that each of the first nozzles and each of the second nozzles are paired with each other, and the slight gap is less than half or half of an interval of the nozzles in the sub scanning direction.

3. A liquid jetting apparatus according to claim 1, wherein:

a volume of the liquid jetted from each of the nozzles at a time is 4 pl or less.

4. A liquid jetting apparatus according to claim 1, wherein:

the controlling unit is also connected to the sub scanning unit, and is adapted to control the liquid jetting unit, the main scanning unit and the sub scanning unit based on a recording mode defined by a sub scan feed amount and information about used nozzles in a main scan.

5. A liquid jetting apparatus according to claim 4, further comprising a recording mode storing unit that stores a plurality of recording modes, and a selecting unit that selects a suitable recording mode among the plurality of recording modes stored in the recording mode storing unit.

6. A liquid jetting apparatus according to claim 1, wherein:

the liquid supplying unit has a first liquid supplying way and a second liquid supplying way, which are adapted to supply the same kind of liquid and are substantially parallel with each other, the plurality of first nozzles are communicated with the first liquid supplying way, the plurality of second nozzles are communicated with the second liquid supplying way, the head member is provided with a third liquid supplying way, a fourth liquid supplying way, a plurality of third nozzles communicated with the third liquid supplying way, and a plurality of fourth nozzles communicated with the fourth liquid supplying way, the third liquid supplying way and the fourth liquid supplying way being adjacent to the first liquid supplying way and the second liquid supplying way, being adapted to supply a same kind of liquid and being substantially parallel with each other, a second liquid jetting unit is provided at each of the third nozzles and the fourth nozzles, the second liquid jetting unit causing each of the third nozzles and the fourth nozzles to jet the liquid, the controlling unit is also connected to the second liquid jetting unit, there is a slight gap between a moving track of a third nozzle by the main scanning unit and a moving track of a fourth nozzle paired with the third nozzle by the main scanning unit, and the controlling unit is adapted to control the liquid jetting unit and the main scanning unit in such a manner that a liquid jetting from the third nozzle and a liquid jetting from the fourth nozzle paired with the third nozzle are carried out in a same main scan, based on jetting data for a same jetting unit area.

7. A liquid jetting apparatus according to claim 1, wherein:

the liquid supplying unit has a first liquid supplying way and a second liquid supplying way, which are adapted to supply the same kind of liquid and are substantially parallel with each other, the plurality of first nozzles are communicated with the first liquid supplying way, the plurality of second nozzles are communicated with the second liquid supplying way, the head member is provided with a third liquid supplying way, a fourth liquid supplying way, a plurality of third nozzles communicated with the third liquid supplying way, and a plurality of fourth nozzles communicated with the fourth liquid supplying way, the third liquid supplying way being formed between the first liquid supplying way and the second liquid supplying way, the fourth liquid supplying way being adjacent to the second liquid supplying way, the third liquid supplying way and the fourth liquid supplying way being adapted to supply a same kind of liquid, a second liquid jetting unit is provided at each of the third nozzles and the fourth nozzles, the second liquid jetting unit causing each of the third nozzles and the fourth nozzles to jet the liquid, the controlling unit is also connected to the second liquid jetting unit, there is a slight gap between a moving track of a third nozzle by the main scanning unit and a moving track of a fourth nozzle paired with the third nozzle by the main scanning unit, and the controlling unit is adapted to control the liquid jetting unit and the main scanning unit in such a manner that a liquid jetting from the third nozzle and a liquid jetting from the fourth nozzle paired with the third nozzle are carried out in a same main scan, based on jetting data for a same jetting unit area.

8. A liquid jetting apparatus comprising;

a first head member having a plurality of first nozzles and a liquid supplying unit that supplies a liquid to each of the plurality of first nozzles, the plurality of first nozzles forming a first nozzle row, a second head member having a plurality of second nozzles and a liquid supplying unit that supplies a same kind of liquid as the liquid supplied to each of the plurality of first nozzles to each of the plurality of second nozzles, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the respective head members to move in a main scanning direction relatively to the recording medium, a sub scanning unit that causes the respective head members to move in a sub scanning direction perpendicular to the main scanning direction relatively to the recording medium, and a controlling unit connected to the liquid jetting unit and the main scanning unit, wherein:

there is a slight gap between a moving track of a first nozzle by the main scanning unit and a moving track of a second nozzle paired with the first nozzle by the main scanning unit, and the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

9. A liquid jetting apparatus comprising;

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, a sub scanning unit that causes the head member to move in a sub scanning direction perpendicular to the main scanning direction relatively to the recording medium, and a controlling unit connected to the liquid jetting unit and the main scanning unit, wherein:

there is a slight gap between a moving track of a first nozzle by the main scanning unit and a moving track of a second nozzle paired with the first nozzle by the main scanning unit, the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area, and the liquid jetting unit can cause the first nozzle to jet a or plural first liquid drops and the second nozzle to jet a or plural second liquid drops each of which has a substantially same volume as the first liquid drop.

10. A liquid jetting apparatus comprising;

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, a sub scanning unit that causes the head member to move in a sub scanning direction perpendicular to the main scanning direction relatively to the recording medium, and a controlling unit connected to the liquid jetting unit and the main scanning unit, wherein:

there is a slight gap between a moving track of a first nozzle by the main scanning unit and a moving track of a second nozzle paired with the first nozzle by the main scanning unit, the controlling unit is adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area, and the liquid jetting unit can cause the first nozzle to jet a first liquid drop and the second nozzle to jet a second liquid drop that has a volume different from that of the first liquid drop.

11. A controlling unit for controlling a liquid jetting apparatus including:

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, and a sub scanning unit that causes the head member to move in a sub scanning direction perpendicular to the main scanning direction relatively to the recording medium;

the controlling unit being adapted to control the main scanning unit in such a manner that there is a slight gap between a moving track of a first nozzle and a moving track of a second nozzle paired with the first nozzle, and adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area.

12. A program executed by a computer system including at least a computer in order to materialize a controlling unit according to claim 11 in the computer system.

13. A program including a command for controlling a second program operable in a computer system including at least a computer, the program being executed by the computer system to control the second program to materialize a controlling unit according to claim 11 in the computer system.

14. A storage medium capable of being read by a computer, storing a program executed by a computer system including at least a computer in order to materialize a controlling unit according to claim 11 in the computer system.

15. A storage unit capable of being read by a computer, storing a program including a command for controlling a second program operable in a computer system including at least a computer, the program being executed by the computer system to control the second program to materialize a controlling unit according to claim 11 in the computer system.

16. A controlling unit for controlling a liquid jetting apparatus including:

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, and a sub scanning unit that causes the head member to move in a sub scanning direction perpendicular to the main scanning direction relatively to the recording medium;

the controlling unit being adapted to control the main scanning unit in such a manner that there is a slight gap between a moving track of a first nozzle and a moving track of a second nozzle paired with the first nozzle, adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area, and adapted to control the liquid jetting unit in such a manner that the liquid jetting unit causes the first nozzle to jet a or plural first liquid drops and the second nozzle to jet a or plural second liquid drops each of which has a substantially same volume as the first liquid drop.

17. A program executed by a computer system including at least a computer in order to materialize a controlling unit according to claim 16 in the computer system.

18. A program including a command for controlling a second program operable in a computer system including at least a computer, the program being executed by the computer system to control the second program to materialize a controlling unit according to claim 16 in the computer system.

19. A storage medium capable of being read by a computer, storing a program executed by a computer system including at least a computer in order to materialize a controlling unit according to claim 16 in the computer system.

20. A storage unit capable of being read by a computer, storing a program including a command for controlling a second program operable in a computer system including at least a computer, the program being executed by the computer system to control the second program to materialize a controlling unit according to claim 16 in the computer system.

21. A controlling unit for controlling a liquid jetting apparatus including:

a head member having a plurality of first nozzles, a plurality of second nozzles and a liquid supplying unit that supplies a same kind of liquid to each of the nozzles, the plurality of first nozzles forming a first nozzle row, the plurality of second nozzles forming a second nozzle row that is paired with the first nozzle row, a liquid jetting unit provided at each of the nozzles, the liquid jetting unit causing each of the nozzles to jet the liquid, a holding unit that holds a recording medium, a main scanning unit that causes the head member to move in a main scanning direction relatively to the recording medium, and a sub scanning unit that causes the head member to move in a sub scanning direction perpendicular to the main scanning direction relatively to the recording medium;

the controlling unit being adapted to control the main scanning unit in such a manner that there is a slight gap between a moving track of a first nozzle and a moving track of a second nozzle paired with the first nozzle, adapted to control the liquid jetting unit and the main scanning unit in such a manner that a liquid jetting from the first nozzle and a liquid jetting from the second nozzle paired with the first nozzle are carried out in a same main scan, based on jetting data for a same jetting unit area, and adapted to control the liquid jetting unit in such a manner that the liquid jetting unit causes the first nozzle to jet a first liquid drop and the second nozzle to jet a second liquid drop that has a volume different from that of the first liquid drop.

22. A program executed by a computer system including at least a computer in order to materialize a controlling unit according to claim 21 in the computer system.

23. A program including a command for controlling a second program operable in a computer system including at least a computer, the program being executed by the computer system to control the second program to materialize a controlling unit according to claim 21 in the computer system.

24. A storage medium capable of being read by a computer, storing a program executed by a computer system including at least a computer in order to materialize a controlling unit according to claim 21 in the computer system.

25. A storage unit capable of being read by a computer, storing a program including a command for controlling a second program operable in a computer system including at least a computer, the program being executed by the computer system to control the second program to materialize a controlling unit according to claim 21 in the computer system.

* * * * *